US007854489B2

(12) United States Patent
Hagiwara et al.

(10) Patent No.: US 7,854,489 B2
(45) Date of Patent: Dec. 21, 2010

(54) IMAGE FORMING APPARATUS

(75) Inventors: Takumi Hagiwara, Aichi (JP); Kenichi Kawabata, Kanagawa (JP); Mamoru Yorimoto, Tokyo (JP); Takayuki Niihara, Kanagawa (JP); Shinichiro Naruse, Kanagawa (JP); Tetsu Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 12/355,176

(22) Filed: Jan. 16, 2009

(65) Prior Publication Data

US 2009/0185813 A1 Jul. 23, 2009

(30) Foreign Application Priority Data

Jan. 18, 2008 (JP) ..... 2008-008849

(51) Int. Cl.
*B41J 2/01* (2006.01)

(52) U.S. Cl. ..... 347/19

(58) Field of Classification Search ..... 347/5, 347/9, 14, 19, 116, 229, 248
See application file for complete search history.

(56) References Cited

U.S. PATENT DOCUMENTS

| | | | | |
|---|---|---|---|---|
| 6,711,364 | B2 * | 3/2004 | Shinohara | 399/49 |
| 7,399,048 | B2 * | 7/2008 | Inoue | 347/19 |
| 2005/0146554 | A1 | 7/2005 | Asanuma et al. | |
| 2005/0194730 | A1 | 9/2005 | Nishida et al. | |
| 2006/0132574 | A1 | 6/2006 | Kawabata | |
| 2006/0146106 | A1 | 7/2006 | Naruse | |
| 2006/0209104 | A1 | 9/2006 | Naruse | |
| 2006/0268053 | A1 | 11/2006 | Naruse | |
| 2007/0035083 | A1 | 2/2007 | Kawabata | |
| 2007/0064032 | A1 | 3/2007 | Kawabata | |
| 2007/0120936 | A1 | 5/2007 | Kawabata | |
| 2007/0126787 | A1 | 6/2007 | Naruse | |
| 2008/0122890 | A1 | 5/2008 | Yorimoto | |
| 2008/0225066 | A1 | 9/2008 | Yorimoto et al. | |
| 2008/0225067 | A1 | 9/2008 | Morino et al. | |
| 2008/0225068 | A1 | 9/2008 | Morino et al. | |
| 2008/0225098 | A1 | 9/2008 | Hagiwara et al. | |
| 2008/0231649 | A1 | 9/2008 | Kawabata et al. | |
| 2009/0184993 | A1 * | 7/2009 | Yorimoto et al. | 347/14 |

FOREIGN PATENT DOCUMENTS

| | | |
|---|---|---|
| JP | 4-39041 | 2/1992 |

(Continued)

*Primary Examiner*—Huan H Tran
(74) *Attorney, Agent, or Firm*—Cooper & Dunham LLP

(57) ABSTRACT

A disclosed image forming apparatus includes a carriage having a head for jetting droplets; a pattern forming unit configured to form, on a belt, a pattern used for detecting displacement of landing positions of the droplets; a reading unit configured to scan the belt before the pattern formation to output a first result, and scan the pattern to output a second result; a correcting unit configured to correct the displacement based on the second result; a frequency analyzing unit configured to calculate frequencies of the belt and amplitudes of respective frequency components based on the first result; and a peak frequency calculating unit configured to calculate peak frequencies of the belt based on the frequencies of the belt and the amplitudes of the frequency components, the peak frequencies being frequency components whose amplitude exceeds a predetermined level. The pattern is formed at a frequency different from the peak frequencies.

8 Claims, 27 Drawing Sheets

FOREIGN PATENT DOCUMENTS

| | | |
|---|---|---|
| JP | 5-249787 | 9/1993 |
| JP | 2004-314361 | 11/2004 |
| JP | 3640629 | 1/2005 |
| JP | 2005-342899 | 12/2005 |
| JP | 2006-178396 | 7/2006 |
| JP | 3838251 | 8/2006 |

* cited by examiner

IMAGE FORMING APPARATUS

BACKGROUND OF THE INVENTION

1. Field of the Invention

The present invention is directed to an image forming apparatus including a recording head that jets liquid droplets.

2. Description of the Related Art

Among image forming apparatuses such as printers, facsimile machines, copiers, plotters and multifunction peripherals having the aforementioned functions for performing image formation, there are liquid jet recording image forming apparatuses including a recording head for jetting, for example, ink droplets. An ink jet recording apparatus is known as an example of such liquid jet recording image forming apparatuses. The liquid jet recording image forming apparatuses jet ink droplets from the recording head onto a sheet being transferred to form an image on the sheet. It is to be noted that the term "sheet" in the present application is not limited only to paper, and refers to a medium onto which ink droplets or another type of liquid is allowed to adhere. Examples of such a medium include an OHP film. The term "sheet" may be referred to also as "recording target", "recording medium", and "recording sheet". Furthermore, in this application, the terms "recording", "printing" and "imaging" are used synonymously with the term "image forming". There are different types of liquid jet recording image forming apparatuses, such as, a serial-type image forming apparatus which forms an image by causing a recording head to jet liquid droplets while moving in the main scanning direction; and a line-type image forming apparatus which forms an image by causing a line-type recording head in a stationary position to jet liquid droplets.

It is also to be noted that the term "image forming apparatus" in the present application refers to an apparatus for forming an image by jetting liquid onto a medium made of, for example, paper, textile threads, fibers, fabric, leather, metal, plastic, glass, wood or ceramic. In addition, the term "image forming" includes forming not only an image having meaning (e.g. characters, figures and symbols) but also an image having no particular meaning (e.g. patterns) on a medium. In this sense, simply depositing liquid droplets on a medium is also regarded as "image forming". The term "ink" is not only directed to substances called ink, but is used as a generic term for all liquid substances allowing image formation, such as recording liquids and fixing liquids.

Such liquid jet recording image forming apparatuses, particularly ones that form an image by causing a carriage having a recording head for jetting liquid droplets to travel in a reciprocating motion (i.e. moving alternately backward and forward), have the following problem. That is, in the case of printing bidirectionally, positional misalignment tends to occur if the printed image is a ruled line. Also, in superposing different colors, a color registration error is likely to occur.

In the case of ink jet recording apparatuses, these problems are handled generally in such a manner that the user selects and inputs optimal values with reference to an output test chart for adjusting misalignment of landing positions of liquid droplets so that the jetting timing is adjusted based on the input results. However, the test chart is subject to individual interpretation, and data input errors may occur due to inexperienced users, thus possibly posing greater problems in the adjustment.

In order to address the problems associated with the test chart, conventionally, a test pattern is formed on a conveying belt or a media conveying member and then read by a sensor (see, for example, Patent Documents 1, 2 and 3).

[Patent Document 1] Japanese Examined Patent Application Publication No. H4-39041

[Patent Document 2] Japanese Laid-open Patent Application Publication No. 2005-342899

[Patent Document 3] Japanese Patent No. 3838251

Patent Document 4 discloses a technique for forming on recording paper a test pattern, which is then read by a sensor.

[Patent Document 4] Japanese Laid-open Patent Application Publication No. 2004-314361

Patent Document 5 discloses a technique in which a positional misalignment correction pattern is formed on a conveying belt and then read by a sensor for detecting the presence or absence of the positional misalignment correction pattern. A filter process is subsequently performed on an output of the sensor using a filter for cutting off frequency components higher than a frequency of the positional misalignment correction pattern. Patent Document 5 discusses that positional misalignment can be corrected by removing high-frequency component noise in this manner.

[Patent Document 5] Japanese Patent No. 3640629

However, in the case of forming a test pattern on a conveying belt or a medium and reading it by a sensor as described above, it is difficult to accurately read the test pattern if there is a small difference between, for example, the color of the conveying belt and the color of an ink used. In order to achieve accurate color detection, a structure is needed such that colors are detected using, for example, light sources having different wavelengths corresponding to respective colors, however, in practice, conventional techniques cannot accurately read the test pattern formed on the conveying belt.

For example, assume that the conveying belt is an electrostatic adsorption belt including an insulating layer on its surface and a medium resistance layer on its rear surface, and carbon is mixed in the medium resistance layer to provide conductivity. In this case, the color of the conveying belt is black, and therefore, pattern detection by measuring only color reflectance has little success since the conveying belt cannot be distinguished from black ink.

In order to resolve this problem, the following technique for accurately detecting the position and positional misalignment of the pattern may be considerable. First, a pattern is formed on a water-repellent pattern formation member so that the pattern is made up of isolated ink droplets. The ink droplets have the characteristic of being separately formed in a hemispherical shape. Using this characteristic, a single-wavelength light beam is projected onto the pattern on the pattern formation member. The specularly reflected light of the projected light beam attenuates over the pattern with the ink droplets, whereby the position and positional misalignment of the pattern can be accurately detected.

However, if a conveying belt, for example, is used as the water-repellent pattern formation member, the surface of the conveying belt changes over time. It is also subject to accidental scratches and dirt build-up caused by paper-dust and paper-jam removing operations. By simply eliminating high-frequency component noise as described in Patent Document 5, low-frequency noise cannot be removed that are caused due to such accidental scratches and dirt as well as the time degradation of the belt, thus interrupting accurate pattern detection.

In view of the above-described issues, the present invention aims at maintaining at a stable level pattern detection accuracy and accuracy of correcting the liquid droplet landing positions.

SUMMARY OF THE INVENTION

In order to resolve the above-mentioned problems, one embodiment of the present invention may be an image forming apparatus including a carriage having a recording head for jetting liquid droplets; a pattern forming unit configured to form, on a conveying belt, an adjustment pattern used for detecting displacement of landing positions of the liquid droplets; a reading unit mounted on the carriage, including a light emitting unit and a light receiving unit, and configured to scan and read the conveying belt before the adjustment pattern is formed so as to output a first reading result, and scan and read the adjustment pattern on the conveying belt so as to output a second reading result; a correcting unit configured to correct the displacement of the landing positions based on the second reading result; a frequency analyzing unit configured to calculate frequencies of the surface of the conveying belt and amplitudes of respective frequency components based on the first reading result; and a peak frequency calculating unit configured to calculate one or more peak frequencies of the surface of the conveying belt based on the frequencies of the surface of the conveying belt and the amplitudes of the frequency components, the peak frequencies being one or more of the frequency components whose amplitude exceeds a predetermined level. The pattern forming unit forms the adjustment pattern at a frequency different from the peak frequencies.

DETAILED DESCRIPTION OF THE PREFERRED EMBODIMENTS

Figure 1:
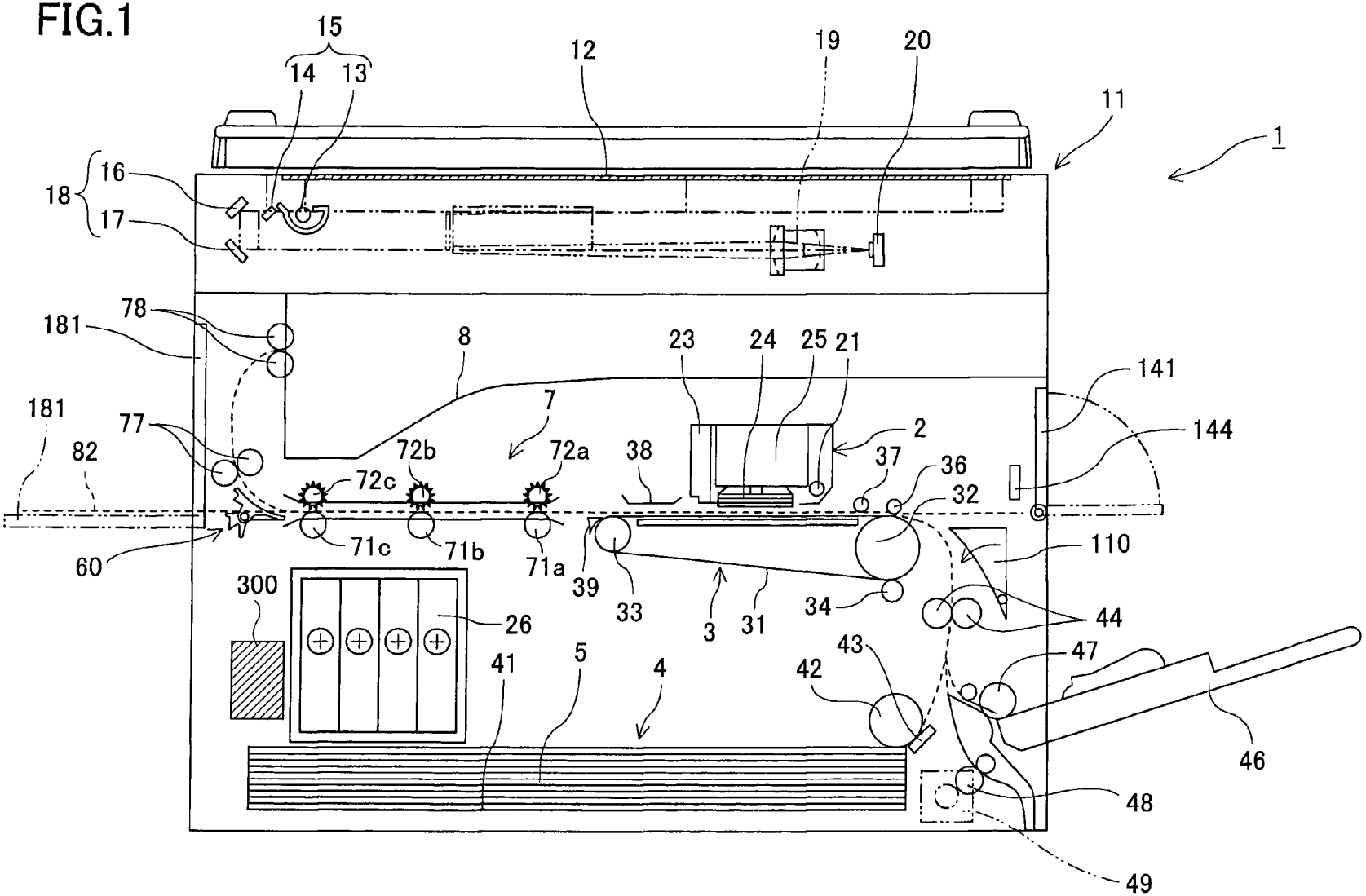
FIG. 1 is a schematic diagram showing an overall structure of an image forming apparatus according to an embodiment of the present invention.
Figure 2:
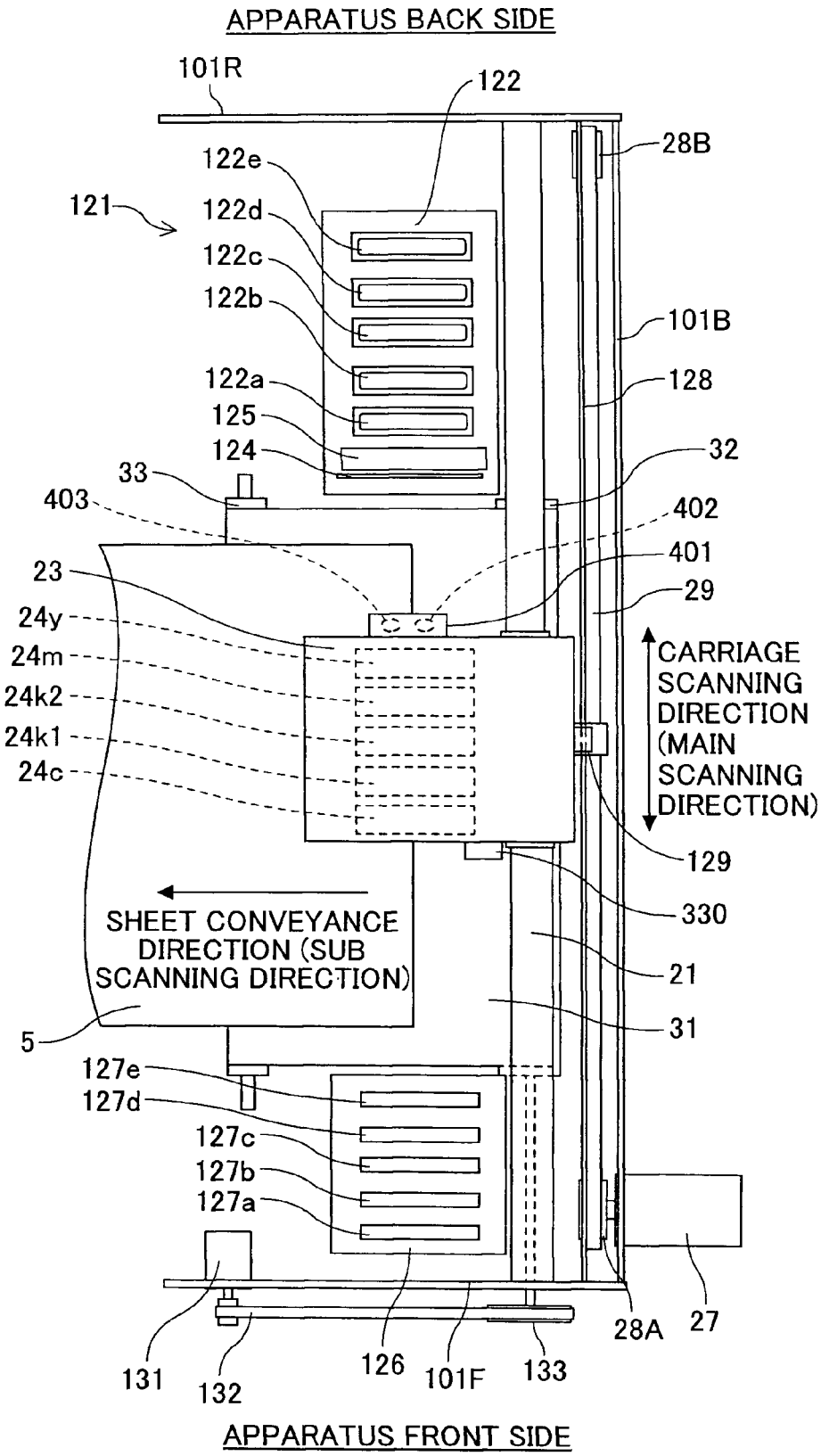
FIG. 2 is a plan view of an image forming unit and a sub scanning conveying unit of the image forming apparatus shown in FIG. 1.
Figure 3:
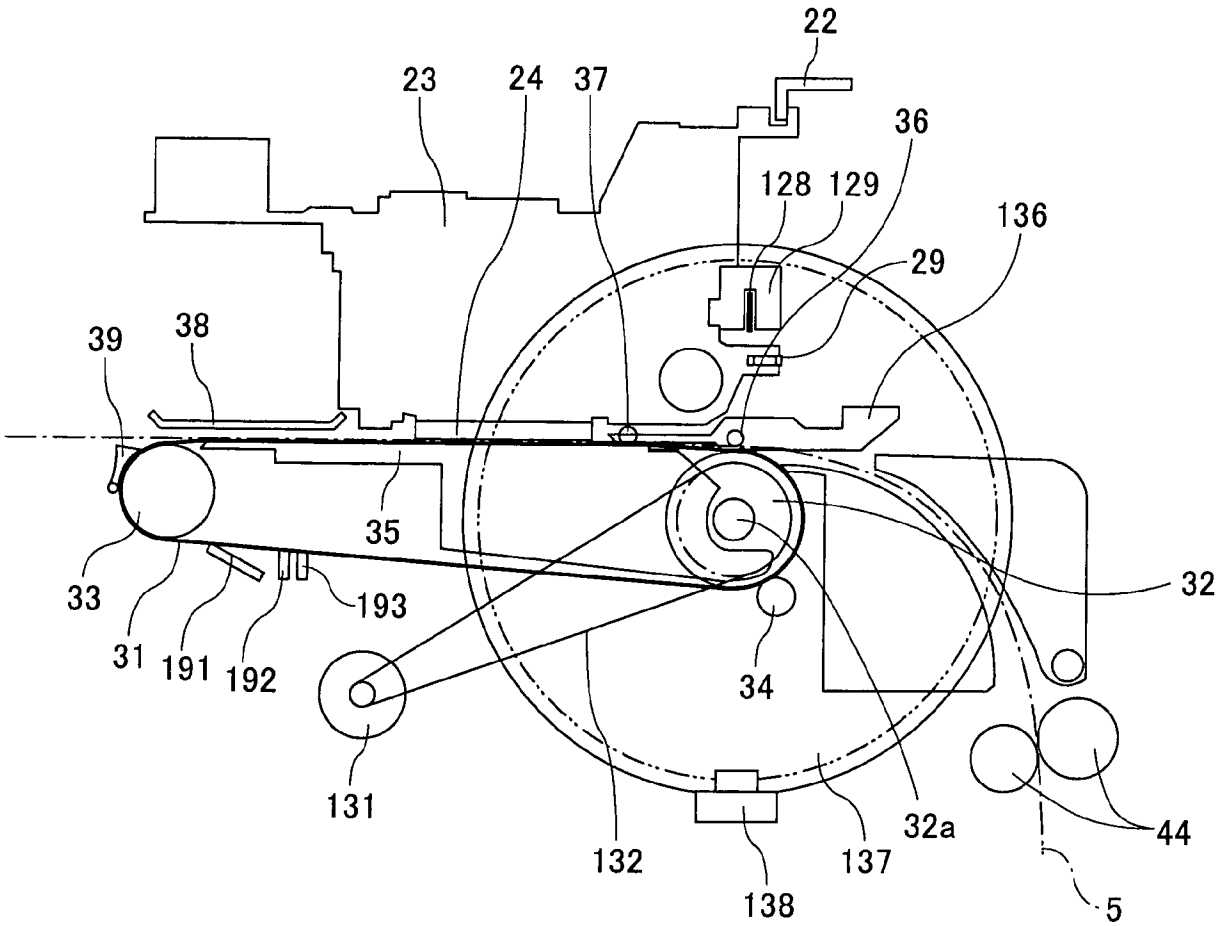
FIG. 3 is a partially transparent side view of the elements shown in FIG. 2.

Embodiments that describe the best mode for carrying out the present invention are explained next with reference to the drawings. The following outlines one example of the image forming apparatus of the present invention which implements a method for correcting liquid droplet landing positions, with reference to FIGS. 1 through 5. FIG. 1 is a schematic diagram showing the overall structure of the image forming apparatus. FIG. 2 is a plan view of an image forming unit and a sub scanning conveying unit of the image forming apparatus, and FIG. 3 is a partially transparent side view of the same.

The image forming apparatus includes an image forming unit 2 and a sub scanning conveying unit 3 disposed inside an apparatus main body 1 (inside a casing). The image forming unit 2 is for forming images while sheets are being conveyed. The sub scanning conveying unit 3 is for conveying sheets. A sheet feeding unit 4 including a sheet feeding cassette disposed at the bottom of the apparatus main body 1 feeds sheets 5 one by one. The sub scanning conveying unit 3 conveys the sheet 5 to a position facing the image forming unit 2. While the sheet 5 is being conveyed, the image forming unit 2 jets liquid droplets onto the sheet 5 to form (record) a desired image. Subsequently, the sheet 5 is ejected, through a sheet eject conveying unit 7, onto a sheet eject tray 8 formed in the upper section of the apparatus main body 1.

Furthermore, the image forming apparatus includes, above the sheet eject tray 8 in the upper section of the apparatus main body 1, an image scanning unit (scanner unit) 11 for scanning images, which is an input system for image data (printing data) to be used by the image forming unit 2 to form an image. In the image scanning unit 11, a scanning optical system 15 including an illumination light source 13 and a mirror 14, and a scanning optical system 18 including mirrors 16 and 17 are moved along for scanning an image of an original placed on a contact glass 12. The scanned original image is read as image signals by an image reading element 20 disposed behind a lens 19. The image signals that have been read are converted into digital signals. An image processing operation is performed on these digital signals. The image-processed printing data can be printed out as an image.

As shown in FIG. 2, in the image forming unit 2 of the image forming apparatus, a cantilevered carriage 23 is held by a guide rod 21 and a not-shown guide rail in such a manner as to be movable in the main scanning direction. The carriage 23 is moved in the main scanning direction by a main scanning motor 27 via a timing belt 29 that is wound around a driving pulley 28A and a subordinate pulley 28B.

As shown in FIG. 2, in the image forming unit 2 of the image forming apparatus, the carriage 23 is held by the carriage guide (guide rod) 21 and a guide stay 22 (see FIG. 3) in such a manner as to be movable in the main scanning direction. The guide rod 21 is a main guide member bridged across a front side plate 101F and a rear side plate 101R. The guide stay 22 is a vertical guide member provided on a rear stay 101B. The carriage 23 is moved in the main scanning direction by the main scanning motor 27 via the timing belt 29 that is wound around the driving pulley 28A and the subordinate pulley 28B.

A total of five liquid droplet jetting heads are provided in the carriage 23. Specifically, there are recording heads 24*k*1, 24*k*2, which are two liquid droplet jetting heads for jetting black (K) ink, and recording heads 24*c*, 24*m*, and 24*y*, each including one liquid droplet jetting head for jetting cyan (C) ink, magenta (M) ink, and yellow (Y) ink, respectively (hereinafter referred to as "recording head 24" when the colors need not be distinguished and when referred to collectively). This carriage 23 is a shuttle type carriage that moves in the main scanning direction to form images by jetting liquid droplets from the recording heads 24, while the sheet 5 is being conveyed in the sheet conveyance direction (sub scanning direction) by the sub scanning conveying unit 3.

Furthermore, sub tanks 25 are provided in the carriage 23 for supplying recording liquid of necessary colors to the recording heads 24. Meanwhile, as shown in FIG. 1, ink cartridges 26 are removably attached to a cartridge insertion unit 26A from the front of the apparatus main body 1. The ink cartridges 26 are recording liquid cartridges for accommodating black (K) ink, cyan (C) ink, magenta (M) ink, and yellow (Y) ink. Ink (recording liquid) is supplied, through tubes (not shown), from the ink cartridges 26 each corresponding to one of the colors to the sub tanks 25 each corresponding to one of the colors. The black ink is supplied from one of the ink cartridges 26 to two of the sub tanks 25.

The recording head 24 can be a piezo type head, a thermal type head, or an electrostatic type head. In the piezo type head, a piezoelectric element is used as a pressure generating unit (actuator unit) for pressurizing the ink inside an ink flow path (pressure generating chamber). The walls of the ink flow path are formed with oscillating plates. These oscillating plates are caused to deform by the piezoelectric element, so that the volume inside the ink flow path changes and ink droplets are jetted outside. In the thermal type head, a heating element is used to heat the ink in the ink flow paths so that bubbles are generated. Due to pressure caused by these bubbles, the ink droplets are jetted outside. In the electrostatic type head, an oscillating plate forming a wall of the ink flow path is disposed in such a manner as to face an electrode. An electrostatic force is generated between the oscillating plate and the electrode. This electrostatic force causes the oscillating plate to deform, so that the volume inside the ink flow path changes and ink droplets are jetted outside.

Furthermore, a linear scale 128 having slits is stretched across from the front side plate 101F to the rear side plate 101R along the main scanning direction of the carriage 23. The carriage 23 is provided with an encoder sensor 129 that is a transmission photosensor for detecting the slits of the linear scale 128. The linear scale 128 and the encoder sensor 129 form a linear encoder for detecting movements of the carriage 23.

On one side of the carriage 23, a pattern reading sensor 401 is provided, which is a reading unit (detecting unit) configured with a reflection photosensor including a light emitting unit and a light receiving unit for reading a landing position detection adjustment pattern (hereinafter referred to as "adjustment pattern") according to an embodiment of the present invention. This pattern reading sensor 401 reads an adjustment pattern formed on a conveying belt 31, as described below. On the other side of the carriage 23, a sheet member detecting unit (leading edge detecting sensor) 330 is provided, which is a reflection photosensor for detecting the leading edge of a material being conveyed.

In a non-printing region on one side of the carriage 23 in the scanning direction, there is provided a maintaining/recovering mechanism (device) 121 for maintaining and recovering the operability of the nozzles of the recording head 24. This maintaining/recovering mechanism 121 is a cap member for capping a nozzle face 24*a* (see FIG. 3) of the five recording heads 24. The maintaining/recovering mechanism 121 includes one suction cap 122*a* that also serves as a moisture retention cap, four moisture retention caps 122*b* through 122*e*, a wiper blade 124 that is a wiping member for wiping the nozzle face 24*a* of the recording heads 24, and an idle jetting reception section 125 for performing idle jetting. In a non-printing region on the other side of the carriage 23 in the scanning direction, another idle jetting reception section 126 is provided for idle jetting. This idle jetting reception section 126 includes openings 127*a* through 127*e*.

As shown in FIG. 3, the sub scanning conveying unit 3 includes an endless conveying belt 31, a charging roller 34, a guide member 35, pressurizing rollers 36 and 37, a guide plate 38, and a separating claw 39. The conveying belt 31 is for changing the conveyance direction of the sheet 5, which has been fed from below, by substantially 90 degrees, and conveying the sheet 5 in such a manner as to face the image forming unit 2. The conveying belt 31 is stretched around a conveying roller 32 that is a driving roller and a subordinate roller 33 that is a tension roller. The charging roller 34 is a charging unit to which a high voltage alternating current is applied from a high voltage power source for charging the surface of the conveying belt 31 (hereinafter sometimes referred to as "belt surface"). The guide member 35 is for guiding the conveying belt 31 in a region facing the image forming unit 2. The pressurizing rollers 36 and 37 are rotatably held by a holding member 136. The pressurizing rollers 36 and 37 are for pressing the sheet 5 against the conveying belt 31 at a position facing the conveying roller 32. The guide plate 38 is for guiding the top face of the sheet 5 with an image formed by the image forming unit 2. The separating claw 39 is for separating, from the conveying belt 31, the sheet 5 with an image.

Figure 4:
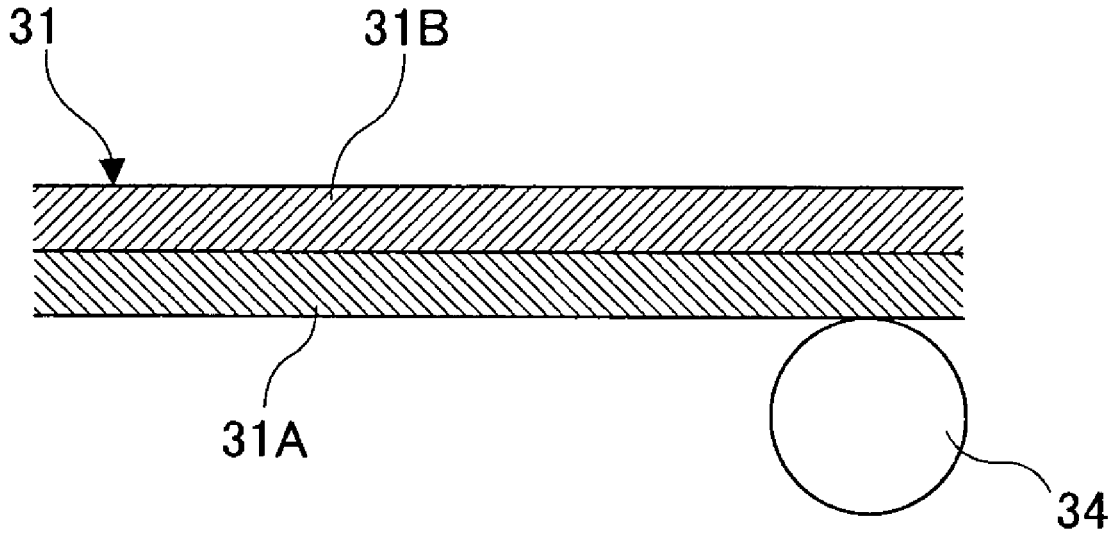
FIG. 4 is a cross-sectional view showing an example of a conveying belt.

The conveying belt 31 is configured to revolve in the sheet conveyance direction (sub scanning direction) as the conveying roller 32 is rotated by a sub scanning motor 131 using a DC brushless motor via a timing belt 132 and a timing roller 133. As shown in FIG. 4, the conveying belt 31 has, for example, a two layer structure including a front layer 31A to which the sheet adheres and a back layer (mid-resistance layer, earth layer) 31B. The front layer 31A is made of a pure resin material such as an ETFE pure material that has not been subjected to resistance control. The back layer 31B is made of the same material as the front layer 31A except that carbon has been added to control the resistance. However, the structure is not limited to the above case, and hence, the conveying belt 31 can have a single layer structure or a structure with three or more layers.

Furthermore, a Mylar unit (paper dust removing unit) 191, a cleaning brush 192, and a discharging brush 193 are provided between the subordinate roller 33 and the charging roller 34, arranged in this order from the upstream side of the movement direction of the conveying belt 31. The Mylar unit 191 is a cleaning unit for removing paper dust, etc., adhering to the surface of the conveying belt 31. The Mylar unit 191 is an abutment member made of a PET film, which abuts the surface of the conveying belt 31. The cleaning brush 192 is a brush that also abuts the surface of the conveying belt 31. The discharging brush 193 is for removing electric charges from the surface of the conveying belt 31.

Moreover, a high-resolution code wheel 137 is attached to a shaft 32*a* of the conveying roller 32. An encoder sensor 138 is provided, which is a transmission photosensor for detecting slits 137*a* formed on this code wheel 137. The code wheel 137 and the encoder sensor 138 form a rotary encoder.

The sheet feeding unit 4 includes a sheet feeding cassette 41, a sheet feeding roller 42, a friction pad 43, and a pair of resist rollers 44. The sheet feeding cassette 41 is an accommodation unit for accommodating multiple stacked sheets 5, and further, the sheet feeding cassette 41 can be inserted in/removed from the apparatus main body 1. The sheet feeding roller 42 and the friction pad 43 are for separating the sheets 5 in the sheet feeding cassette 41 from each other and sending them out one by one. The resist rollers 44 are for resisting the sheet 5 being fed.

Furthermore, the sheet feeding unit 4 includes a manual feed tray 46, a manual feed roller 47, and a vertical conveying roller 48. The manual feed tray 46 is for accommodating multiple stacked sheets 5. The manual feed roller 47 is for feeding the sheets 5 one by one from the manual feed tray 46. The vertical conveying roller 48 is for conveying the sheet 5 that is fed from a sheet feeding cassette that is optionally installed at the bottom of the apparatus main body 1 or from a double-side unit. Members for feeding the sheet 5 to the sub scanning conveying unit 3, such as the sheet feeding roller 42, the resist rollers 44, the manual feed roller 47, and the vertical conveying roller 48, are rotated by a sheet feeding motor (driving unit) 49 that is an HB type stepping motor, via a not-shown electromagnetic clutch.

The sheet eject conveying unit 7 includes three conveying rollers 71*a*, 71*b*, and 71*c* (referred to as "conveying rollers 71" when not distinguished) and spurs 72*a*, 72*b*, and 72*c* (referred to as "spurs 72" when not distinguished) that face the conveying rollers 71, a pair of reverse rollers 77, and a pair of reverse sheet eject rollers 78. The conveying rollers 71 are for conveying the sheet 5 which has been separated from the conveying belt 31 by the separating claw 39 of the sub scanning conveying unit 3. The reverse rollers 77 and the reverse sheet eject rollers 78 are for reversing the sheet 5 and sending the sheet 5 face-down to the sheet eject tray 8.

Furthermore, in order to manually feed a single sheet, as shown in FIG. 1, on one side of the apparatus main body 1 there is provided a single sheet manual feed tray 141 that can be opened and closed (in such a manner as to be unfolded) with respect to the apparatus main body 1. When a single sheet is to be fed manually, the single sheet manual feed tray 141 is opened (unfolded) to the position indicated by a horizontal virtual line in FIG. 1. The sheet 5 that is fed manually from the single sheet manual feed tray 141 is guided along the top surface of a guide plate 110 and is then linearly inserted in between the conveying roller 32 and the pressurizing roller 36 of the sub scanning conveying unit 3.

Meanwhile, in order to eject the sheet 5 on which an image has been formed face-up and in a straight manner, a straight sheet eject tray 181 that can be opened and closed (unfolded) is provided on the other side of the apparatus main body 1. By opening (unfolding) this straight sheet eject tray 181, the sheet 5 that is sent out from the sheet eject conveying unit 7 can be linearly ejected to the straight sheet eject tray 181.

Figure 5:
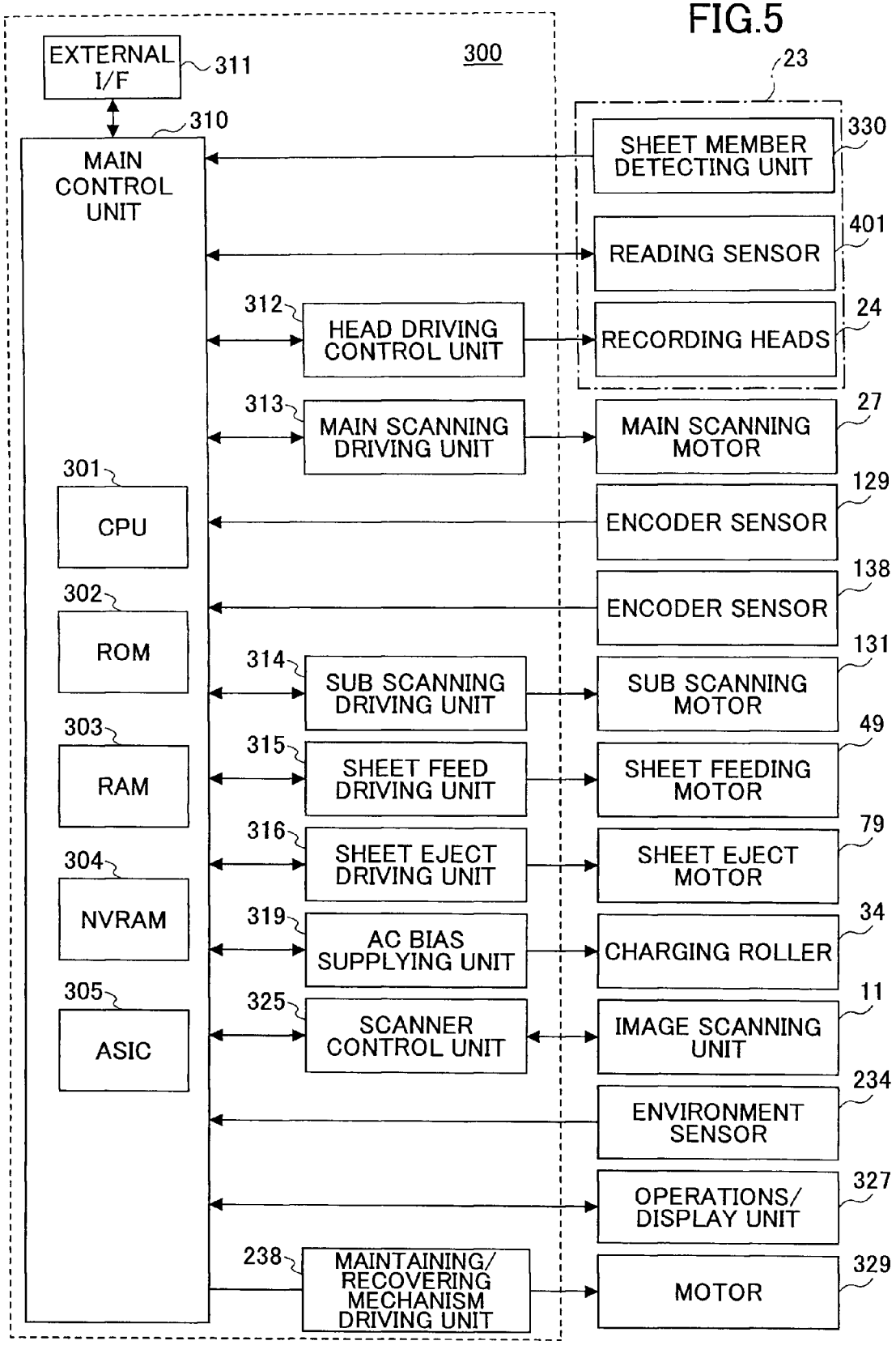
FIG. 5 is a block diagram schematically illustrating a control unit.

Next, an overview of a control unit of this image forming apparatus is described with reference to a block diagram shown in FIG. 5.

A control unit 300 includes a main control unit 310 for controlling the entire apparatus as well as specific operations according to embodiments of the present invention such as pre-scanning, a frequency analysis, a peak frequency calculation, formation of adjustment patterns, detection of the adjustment patterns, and adjustment (correction) of landing positions. The main control unit 310 includes a CPU 301, a ROM 302 for storing a program to be executed by the CPU 301 and other fixed data, a RAM 303 for temporarily storing image data, etc., a nonvolatile memory (NVRAM) 304 for holding data even while the power of the apparatus is shut off, and an ASIC 305 for performing various signal processes on the image data, image processes such as sorting, and other processes on input/output signals to control the entire apparatus.

Furthermore, the control unit 300 includes an external I/F 311, a head driving control unit 312, a main scanning driving unit (motor driver) 313, a sub scanning driving unit (motor driver) 314, a sheet feed driving unit 315, a sheet eject driving unit 316, and an AC bias supplying unit 319. The external I/F 311 is provided between the host side and the main control unit 310 for transmitting/receiving data and signals. The head driving control unit 312 includes a head driver (actually provided in the recording head 24) configured with a head data generating rearranging ASIC for driving/controlling the recording head 24. The main scanning driving unit 313 is for driving the main scanning motor 27 to move the carriage 23. The sub scanning driving unit 314 is for driving the sub scanning motor 131. The sheet feed driving unit 315 is for driving the sheet feeding motor 49. The sheet eject driving unit 316 is for driving a sheet eject motor 79 which drives the rollers of the sheet eject conveying unit 7. The AC bias supplying unit 319 is for supplying an AC bias to the charging roller 34. Although not shown, the control unit 300 also includes a recovering system driving unit for driving a maintaining/recovering motor which drives the maintaining/recovering mechanism 121, a double side driving unit for driving a double side unit if the double side unit is installed, a solenoid driving unit (driver) for driving various solenoids (SOL), a clutch driving unit for driving electromagnetic clutches, and a scanner control unit 325 for controlling the image scanning unit 11.

Various detection signals of an environment sensor 234 for detecting, for example, the temperature and the humidity around the conveying belt 31 (environment conditions) are input to the main control unit 310. Detection signals of other not-shown sensors are also input to the main control unit 310. Furthermore, the main control unit 310 acquires necessary key input from various keys provided in the apparatus main body 1 such as a numeric keypad and a print start key, and outputs display information to an operations/display unit 327 including various display devices.

Moreover, output signals from the photosensor (encoder sensor) 129, which is a part of the linear encoder for detecting the above-described carriage position, are input to the main control unit 310. Based on these output signals, the main control unit 310 moves the carriage 23 back and forth in the main scanning direction by driving/controlling the main scanning motor 27 via the main scanning driving unit 313. Furthermore, output signals (pulses) from the photosensor (encoder sensor) 138, which is a part of the rotary encoder for detecting the movement amount of the above-described conveying belt 31, are input to the main control unit 310. Based on these output signals, the main control unit 310 moves the conveying belt 31 via the conveying roller 32 by driving/controlling the sub scanning motor 131 via the sub scanning driving unit 314.

The main control unit 310 pre-scans the conveying belt 31 using the reading sensor 401 and then carries out a frequency analysis for calculating frequencies of the surface of the conveying belt 31 and amplitudes of respective frequency components. Based on the obtained frequencies and amplitudes, the main control unit 310 calculates frequency components exceeding a predetermined level (referred to as "peak frequencies") and forms an adjustment pattern on the conveying belt 31 at a frequency different from the calculated peak frequencies. The main control unit 310 performs a light emitting driving control operation for emitting light onto the formed adjustment pattern from the pattern reading sensor 401 installed in the carriage 23. Output signals from the light receiving unit are input to the main control unit 310 so as to read the adjustment pattern. From the reading results, the main control unit 310 detects the landing positional misalignment amount, and performs a control operation based on the landing positional misalignment amount to correct the timings at which liquid droplets are jetted from the recording heads 24 so as to eliminate the landing positional misalignment. This process is described in detail later.

When carrying out a maintenance/recovery operation of the recording heads 24, the main control unit 310 drives/controls a driving motor 239 of the maintaining/recovering mechanism 121 via a maintaining/recovering mechanism driving unit 238 so as to move up and down the caps 122, the wiper blade (wiper member) 124 and the like.

A brief description is given of an image forming operation of the image forming apparatus having the above configuration. The rotation amount of the conveying roller 32 for driving the conveying belt 31 is detected. According to the detected rotation amount, the sub scanning motor 131 is driven/controlled, and high voltage alternating current rectangular waves of positive and negative polarities are applied from the AC bias supplying unit 319 to the charging roller 34. Accordingly, positive and negative charges are alternately applied onto the conveying belt 31 in a striped manner with respect to the conveyance direction of the conveying belt 31. Thus, the conveying belt 31 is charged with predetermined charge widths so that a non-uniform electric field is generated.

The sheet 5 is fed from the sheet feeding unit 4, and is sent in between the conveying roller 32 and the first pressurizing roller 36. When the sheet 5 is sent onto the conveying belt 31, on which charges of positive and negative polarities are formed so that a non-uniform electric field is generated, the sheet 5 immediately becomes polarized according to the direction of the electric field. Then, the sheet 5 adheres onto the conveying belt 31 due to an electrostatic adhering force, so that it is conveyed along with the movement of the conveying belt 31.

The sheet 5 is intermittently conveyed by the conveying belt 31. The carriage 23 is moved in the main scanning direction to jet droplets of recording liquid from the recording heads 24 onto the stationary sheet 5 so as to record (print) an image. The leading edge of the sheet 5 which has undergone the printing operation is separated from the conveying belt 31 with the separating claw 39. The sheet 5 is then sent out to the sheet eject conveying unit 7 and is ejected onto the sheet eject tray 8.

Furthermore, during standby periods between printing (recording) operations, the carriage 23 is moved to the maintaining/recovering mechanism 121. The nozzle faces of the recording heads 24 are capped by the caps 122 so that the nozzles are maintained in a moist condition. This prevents jetting failures that may be caused when the ink becomes dry. Furthermore, a recovery operation is performed by suctioning the recording liquid through the nozzles and discharging viscous recording liquid and bubbles, where the recording heads 24 are capped by suction and moisture retention caps 122. By performing this recovery operation, ink adheres to the nozzle faces of the recording heads 24. In order to clean/remove this ink, the wiper blade 124 is used to wipe off the ink. Furthermore, before starting the recording operation or during the recording operation, the recording heads 24 perform idle jetting operations by jetting ink into the idle jetting reception section 125, which ink is unrelated to the recording operation. Accordingly, the jetting performance of the recording heads 24 can be maintained at a stable level.

Figure 6:
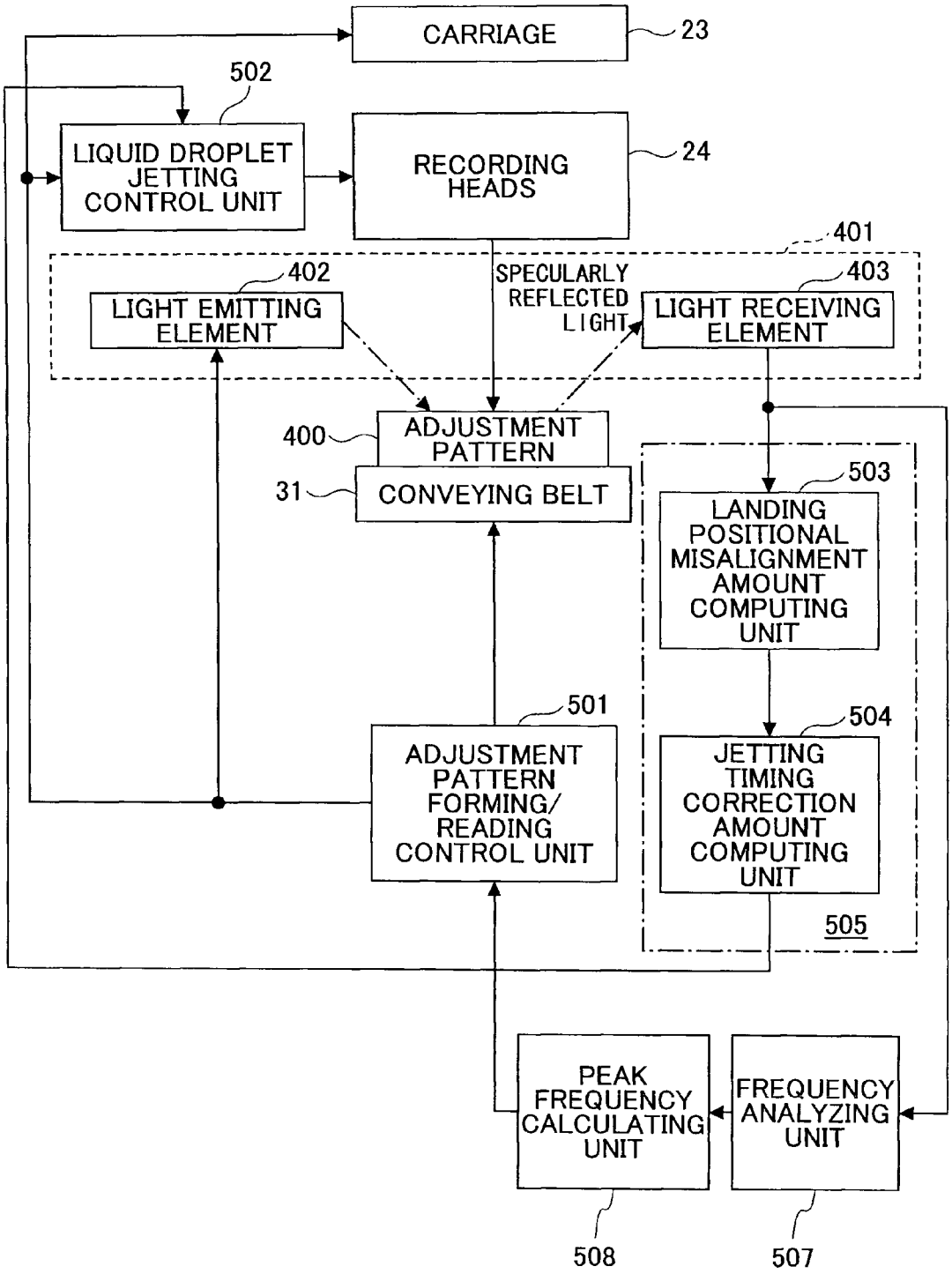
FIG. 6 is a functional block diagram of parts of the image forming apparatus relating to detection and correction of droplet landing positions.
Figure 7:
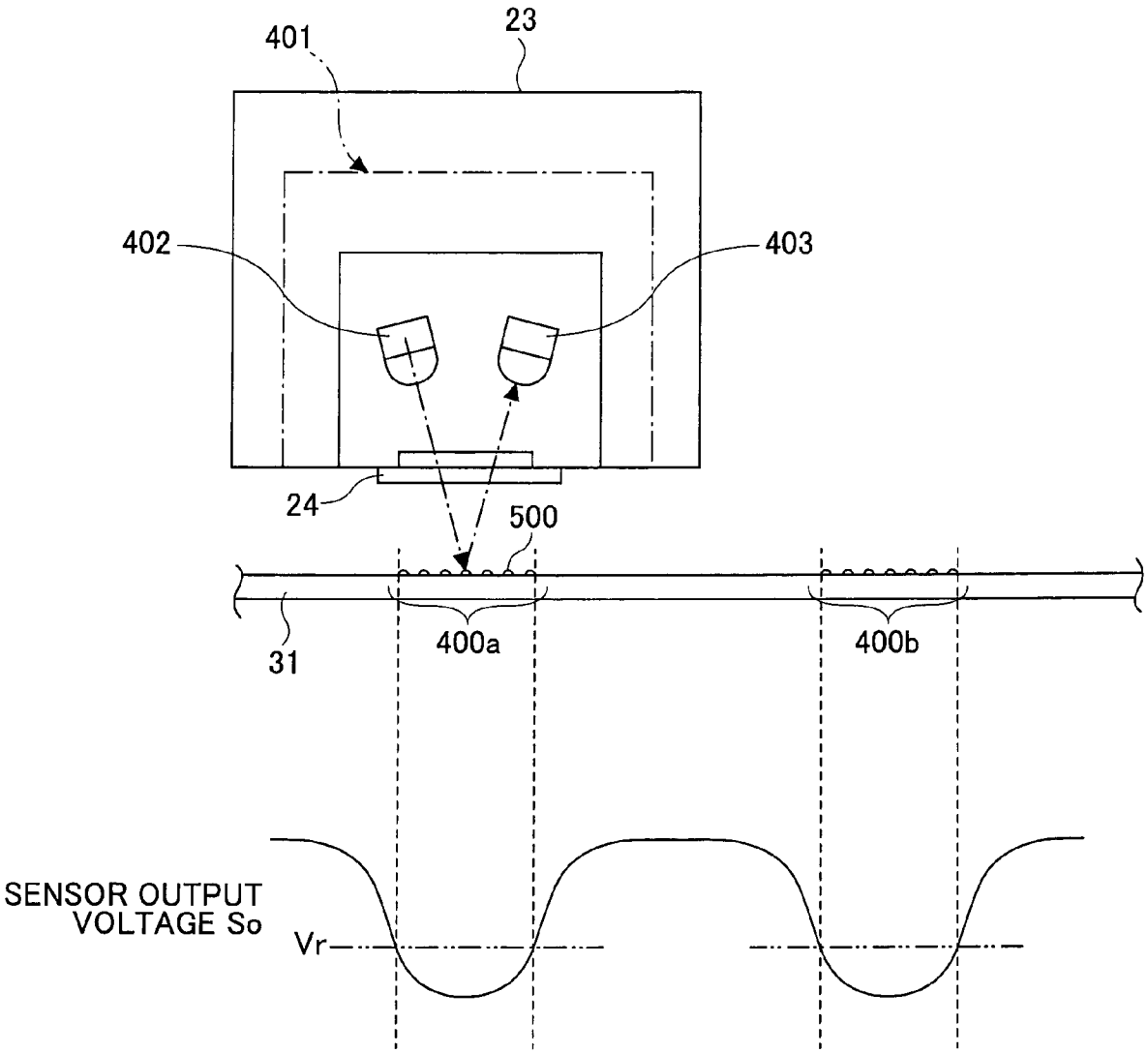
FIGS. 7A and 7B are diagrams illustrating the detection and correction of droplet landing positions.

Next, the units relevant to landing positional misalignment correction control in the image forming apparatus are described with reference to FIGS. 6 and 7. FIG. 6 is a block diagram illustrating the functions of the landing positional misalignment correction unit. FIG. 7 illustrates a landing positional misalignment correction operation.

Figure 8:
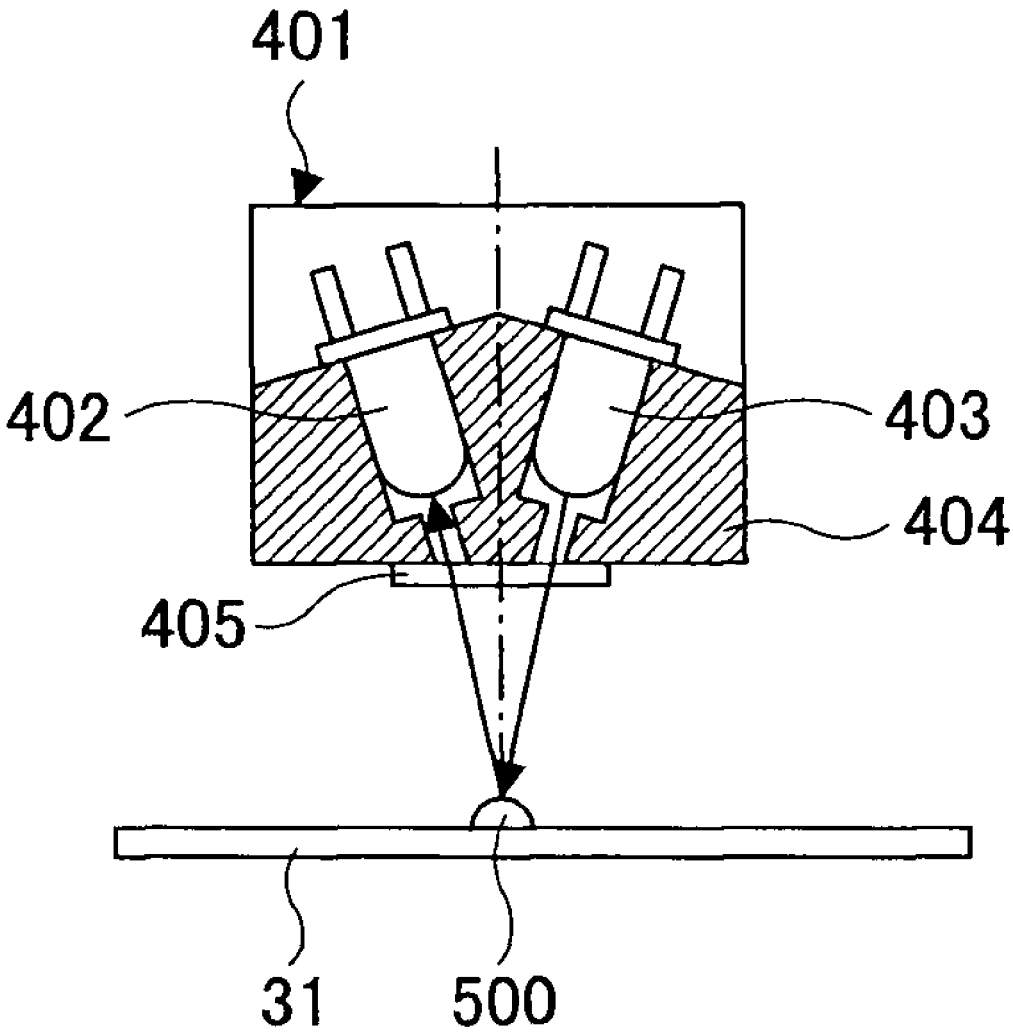
FIG. 8 illustrates a pattern reading sensor.

As shown in FIGS. 7 and 8, the carriage 23 is provided with the pattern reading sensor 401 for reading the adjustment pattern (also referred to as landing position detection adjustment pattern, test pattern, detection pattern, etc.) formed on the conveying belt 31, which is a water-repellent member. Note that an adjustment pattern 400 includes at least a reference pattern 400*a* and a pattern to be measured (hereinafter simply "measurement pattern") 400*b*, as shown in FIG. 7.

The pattern reading sensor 401 includes a light emitting element 402 and a light receiving element 403, which are arranged in a direction perpendicular to the main scanning direction, and are held and packaged in a holder 404. The light emitting element 402 is a light emitting unit for emitting light onto the adjustment pattern 400 on the conveying belt 31. The light receiving element 403 is a light receiving unit for receiving specularly reflected light from the adjustment pattern 400. A lens 405 is provided at the light beam outgoing part and the light beam incoming part of the holder 404.

Inside the pattern reading sensor 401, the light emitting element 402 and the light receiving element 403 are arranged in a direction perpendicular to the main scanning direction of the carriage 23, which main scanning direction is indicated in FIG. 2. Accordingly, the detection results (reading results) are less affected by fluctuations in the movement speed of the carriage 23. Furthermore, a relatively simple and inexpensive light source can be used as the light emitting element 402, for example, an LED emitting light in an infrared region or visible light. Furthermore, the spot diameter (detection range, detection region) of the light source is detected in units of millimeters because an inexpensive lens is used instead of a high-precision lens.

When a landing positional misalignment correction operation is directed, an adjustment pattern forming/reading control unit 501 performs pre-scanning by causing the carriage 23 to scan in the main scanning direction so that the reading sensor 401 reads the surface of the conveying belt 31. Then, a sensor output from the reading sensor 401 is read and detected by a frequency analyzing unit 507.

Based on the sensor output of the reading sensor 401, the frequency analyzing unit 507 calculates frequencies of the surface of the conveying belt 31 and amplitudes of respective frequency components, and outputs them to a peak frequency calculating unit 508. Based on the calculations of the frequency analyzing unit 507, the peak frequency calculating unit 508 calculates only frequency components exceeding a predetermined level (peak frequencies), and gives the calculated frequency components to the adjustment pattern forming/reading control unit 501.

In response, the adjustment pattern forming/reading control unit 501 causes, via a liquid droplet jetting control unit 502, the recording heads 24 functioning as liquid droplet jetting units to jet liquid droplets while causing the carriage 23 to scan the conveying belt 31 in the main scanning direction. Accordingly, the line-shaped reference and measurement patterns 400*a* and 400*b* (collectively referred to as "adjustment pattern 400") are formed with multiple isolated liquid droplets 500. At this point, the reference pattern 400*a* and the measurement pattern 400*b* are formed in such a manner that a frequency of the adjustment pattern 400 (hereinafter, "pattern frequency") is different from the frequencies of the belt surface.

The adjustment pattern forming/reading control unit 501 reads, with the pattern reading sensor 401, the adjustment pattern 400 formed on the conveying belt 31. This adjustment pattern reading control operation is performed by emitting light from the light emitting element 402 of the pattern reading sensor 401 while moving the carriage 23 in the main scanning direction, so that light output from the light emitting element 402 is irradiated onto the adjustment pattern 400 on the conveying belt 31.

In the pattern reading sensor 401, as light output from the light emitting element 402 is irradiated onto the adjustment pattern 400 on the conveying belt 31, the specularly reflected light from the adjustment pattern 400 is irradiated into the light receiving element 403. The light receiving element 403 outputs detection signals according to the amount of the specularly reflected light received from the adjustment pattern 400. These detection signals are input to a landing positional misalignment amount computing unit 503 of a landing position correction unit 505.

The landing positional misalignment amount computing unit 503 of the landing position correction unit 505 detects the position of the adjustment pattern 400 based on output results from the light receiving element 403 of the pattern reading sensor 401, and calculates the shift amount with respect to a reference position (landing positional misalignment amount). The landing positional misalignment amount calculated by the landing positional misalignment amount computing unit 503 is output to a jetting timing correction amount computing unit 504. The jetting timing correction amount computing unit 504 calculates the correction amount of the jetting timing so that there are no misalignment in the landing positions when the liquid droplet jetting control unit 502 drives the recording heads 24. The jetting timing correction amount computing unit 504 sets the calculated jetting timing correction amount in the liquid droplet jetting control unit 502. Accordingly, the liquid droplet jetting control unit 502 can drive the recording heads 24 at jetting timings that have been corrected based on the correction amount. Thus, the misalignment in the liquid droplet landing positions can be reduced.

Principles of the formation and detection of the adjustment pattern 400 according to an embodiment of the present invention are described next with reference to FIGS. 9 through 13.

Figures 9A, 9B:
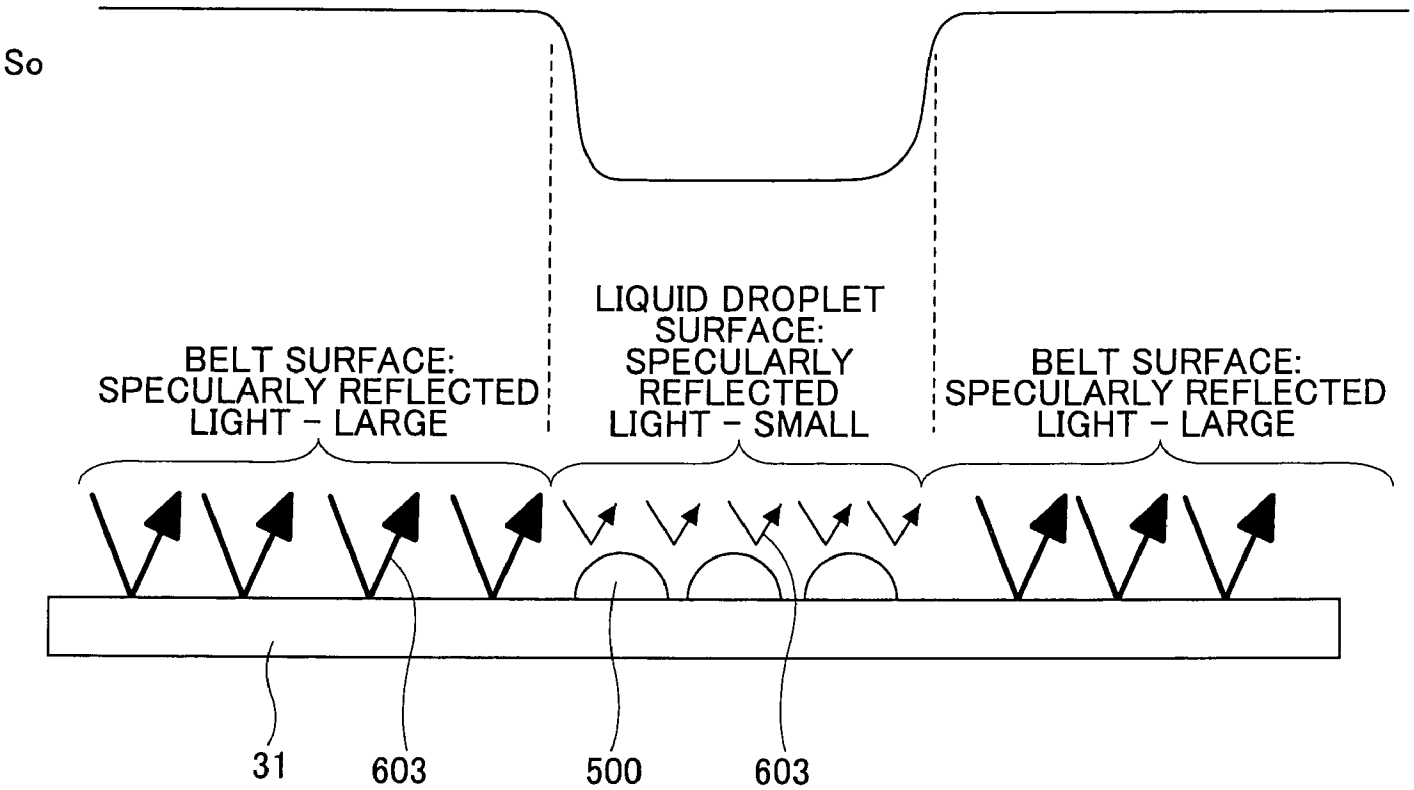
FIGS. 9A and 9B are diagrams illustrating principles of formation and detection of an adjustment pattern on a conveying belt.
Figure 11:
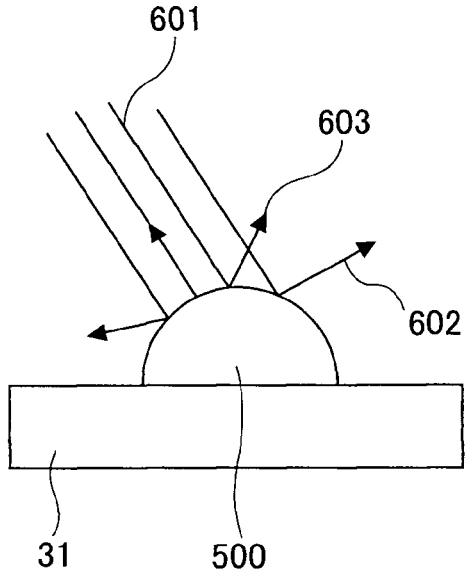
FIG. 11 illustrates how light diffuses from a liquid droplet for describing the principle of pattern detection.

As shown in FIG. 9B, the adjustment pattern 400 is formed on the conveying belt 31 with multiple isolated liquid droplets 500 (the landed ink drop 500 becomes a hemisphere). As shown in FIG. 11, incident light 601 from the light emitting element 402 hits an ink droplet 500. Because the liquid droplet 500 has a round, lustrous surface, most of the incident light 601 turns into diffuse reflection light 602. Hence, only a small amount of the light can be detected as specularly reflected light 603.

In this case, the surface of the conveying belt 31 (belt surface) is made lustrous and therefore tends to readily yield specularly reflected light when light is received from the light emitting element 402 of the pattern reading sensor 401. When light output from the light emitting element 402 is irradiated onto the surface of the conveying belt 31 on which the adjustment pattern 400 is formed with multiple isolated liquid droplets 500, the amount of specularly reflected light 603 decreases in the region where the adjustment pattern 400 is formed since the light is diffused on the surfaces of the lustrous, hemispheric ink droplets 500. Therefore, the output (sensor output voltage So) from the light receiving element 403 for receiving the specularly reflected light 603 is relatively small.

Accordingly, the position of the adjustment pattern 400 formed on the conveying belt 31 can be detected based on the sensor output voltage So of the pattern reading sensor 401.

Figures 10A, 10B:
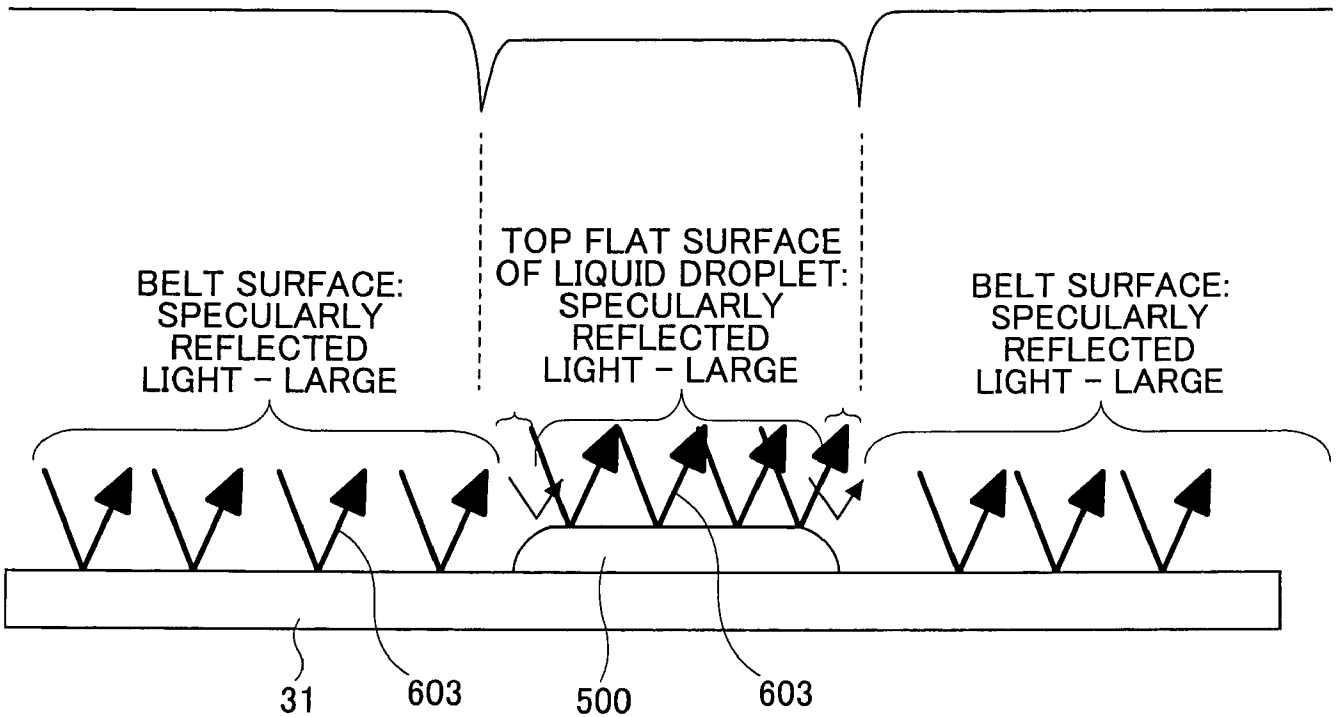
FIGS. 10A and 10B are schematic diagrams illustrating an adjustment pattern of a comparative example.

In a comparative example, as illustrated in FIG. 10B, when the adjacent ink drops have contacted each other and have become connected to each other on the conveying belt 31, the top surface of the connected ink drops 500 becomes flat. As a result, the amount of specularly reflected light 603 increases. Therefore, as illustrated in FIG. 10A, the output value of the sensor output voltage So becomes substantially the same for the region on the conveying belt 31 without the ink droplets 500 and the region with the ink droplets 500, which makes it difficult to detect the positions of the ink droplets 500. Even when the ink droplets 500 have become connected to each other, diffuse light is generated at the edges of the connected ink drop 500. Nevertheless, detection is still difficult because the diffuse light is generated from extremely small portions. If an attempt were made to detect the ink drops, the area to be examined with the light receiving element 403 (region to be detected) would need to be narrowed down. Accordingly, the detection may be affected by noise elements such as slight scratches or dust on the surface of the conveying belt 31, which may decrease the detection precision and/or degrade the reliability of detection results.

Figure 12:
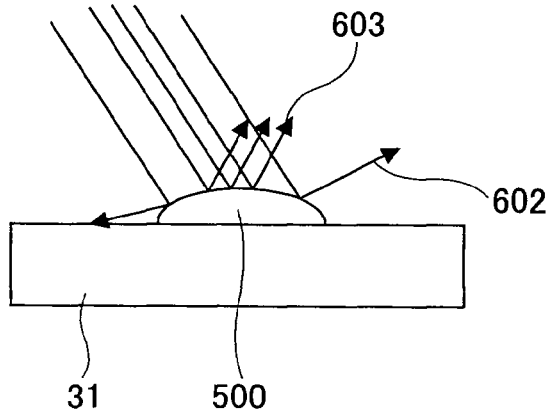
FIG. 12 illustrates how light diffuses when the liquid droplet has become flat.
Figure 13:
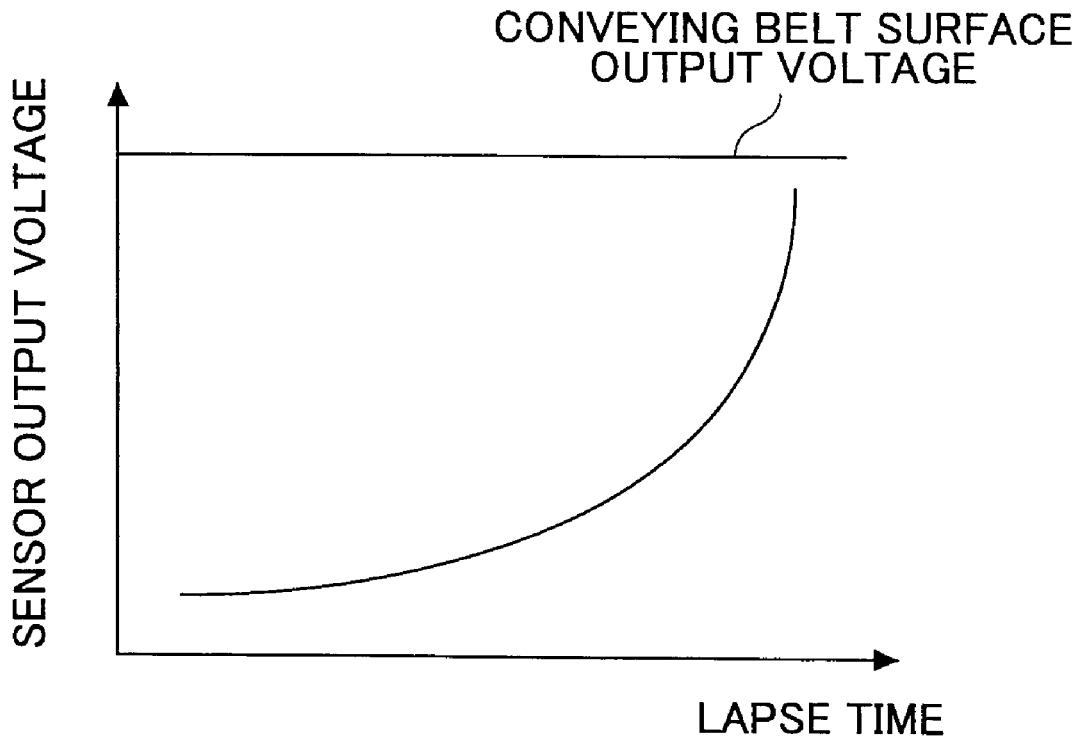
FIG. 13 illustrates the relationship between the passage of time after the liquid droplet lands and the sensor output voltage.

Note that, as shown in FIG. 12, the liquid droplet 500 dries with the passage of time, and therefore the surfaces looses luster, and the shape gradually changes into a flat shape from the hemispheric shape. As a result, the range and proportion of the specularly reflected light 603 becomes relatively larger than those of the diffuse reflection light 602, and eventually, the specularly reflected light 603 reflected off the region with the adjustment pattern 400 becomes indistinguishable from the specularly reflected light reflected off the surface of the conveying belt 31. Accordingly, when the specularly reflected light 603 is received by the light receiving element 403, the sensor output voltage So approaches with the passage of time the output voltage obtained for light reflected off the surface of the conveying belt 31, as shown in FIG. 13. Thus, since the detection precision decreases with the passage of time, the detection of the adjustment pattern 400 is preferably performed before the ink droplets 500 in the formed adjustment pattern 400 become flat.

Thus, using the output from the light receiving unit for receiving specularly reflected light from the ink droplets, the adjustment pattern is detected by identifying portions where specularly reflected light is attenuated. Accordingly, the adjustment pattern is detected with high precision. In this case, the adjustment pattern 400 is preferably formed, in the detection region of the pattern reading sensor 401, with multiple liquid droplets that are separated from each other. More preferably, the ink droplets are close to each other (in the detection region, the area between the ink droplets is smaller than the adhering area where the ink drops are adhering to the belt surface).

In view of the characteristics unique to the liquid droplets, the adjustment pattern is formed with multiple isolated liquid droplets on the conveying belt which is a water-repellent pattern formation member. Herewith, the adjustment pattern can be detected with high precision according to the difference in the amount of specularly reflected light in the region on the conveying belt without the ink droplets and the region with the ink droplets. As a result, gap deviation can be detected with high precision.

Next, different examples of a position detection process of the adjustment pattern 400 formed on the conveying belt 31 and a distance calculation process for calculating the distance between the patterns 400*a* and 400*b* are described with reference to FIGS. 14A through 16B.

Figure 14A:
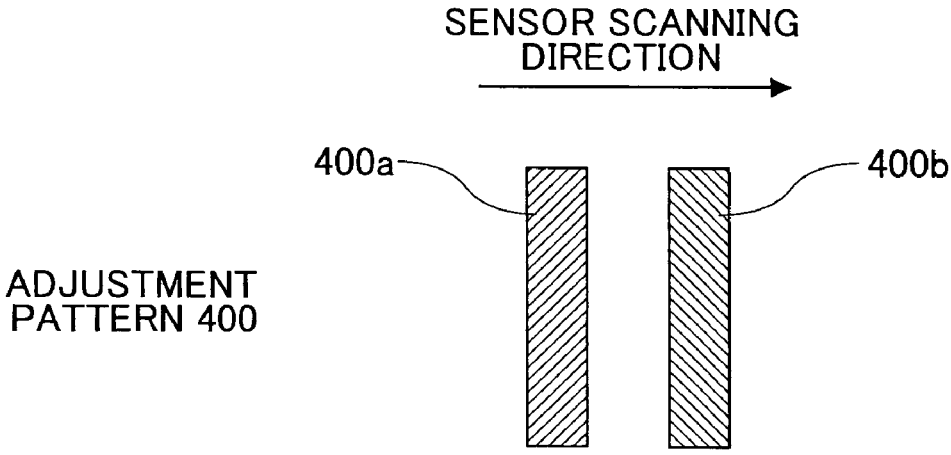
FIGS. 14A and 14B illustrate a first example of a process for detecting the position of an adjustment pattern.
Figure 14B:
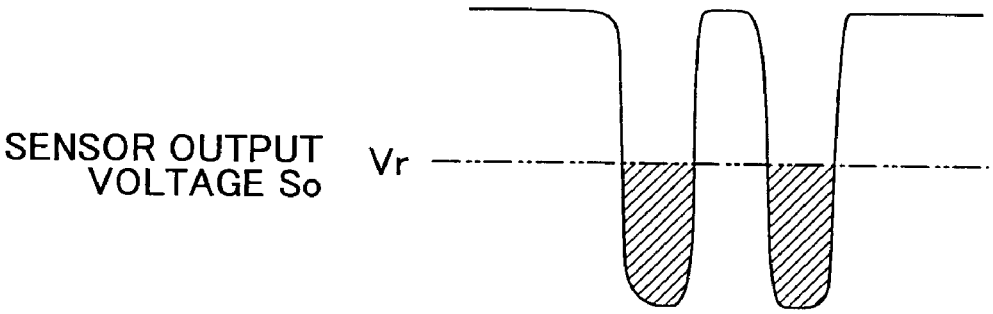

FIGS. 14A and 14B illustrate a first example. As shown in FIG. 14A, the reference pattern 400*a* and the measurement pattern 400*b* are formed on the conveying belt 31. These are scanned with the pattern reading sensor 401 in the sensor scanning direction (carriage main scanning direction). Based on the output results from the light receiving element 403 of the pattern reading sensor 401, as shown in FIG. 14B, a sensor output voltage So is obtained, which falls at the reference pattern 400*a* and the measurement pattern 400*b*.

By comparing the sensor output voltage So with a predetermined threshold Vr, the positions at which the sensor output voltage So becomes lower than the threshold Vr can be detected as edges of the reference pattern 400*a* and the measurement pattern 400*b*. The area centroid of the region surrounded by the lines representing the threshold Vr and the sensor output voltage So (the hatched parts in the figure) is calculated. This area centroid can be set to be the center of the patterns 400*a* and 400*b*. By using a centroid, it is possible to reduce errors caused by microscopic variations of the sensor output voltage.

Figure 15A:
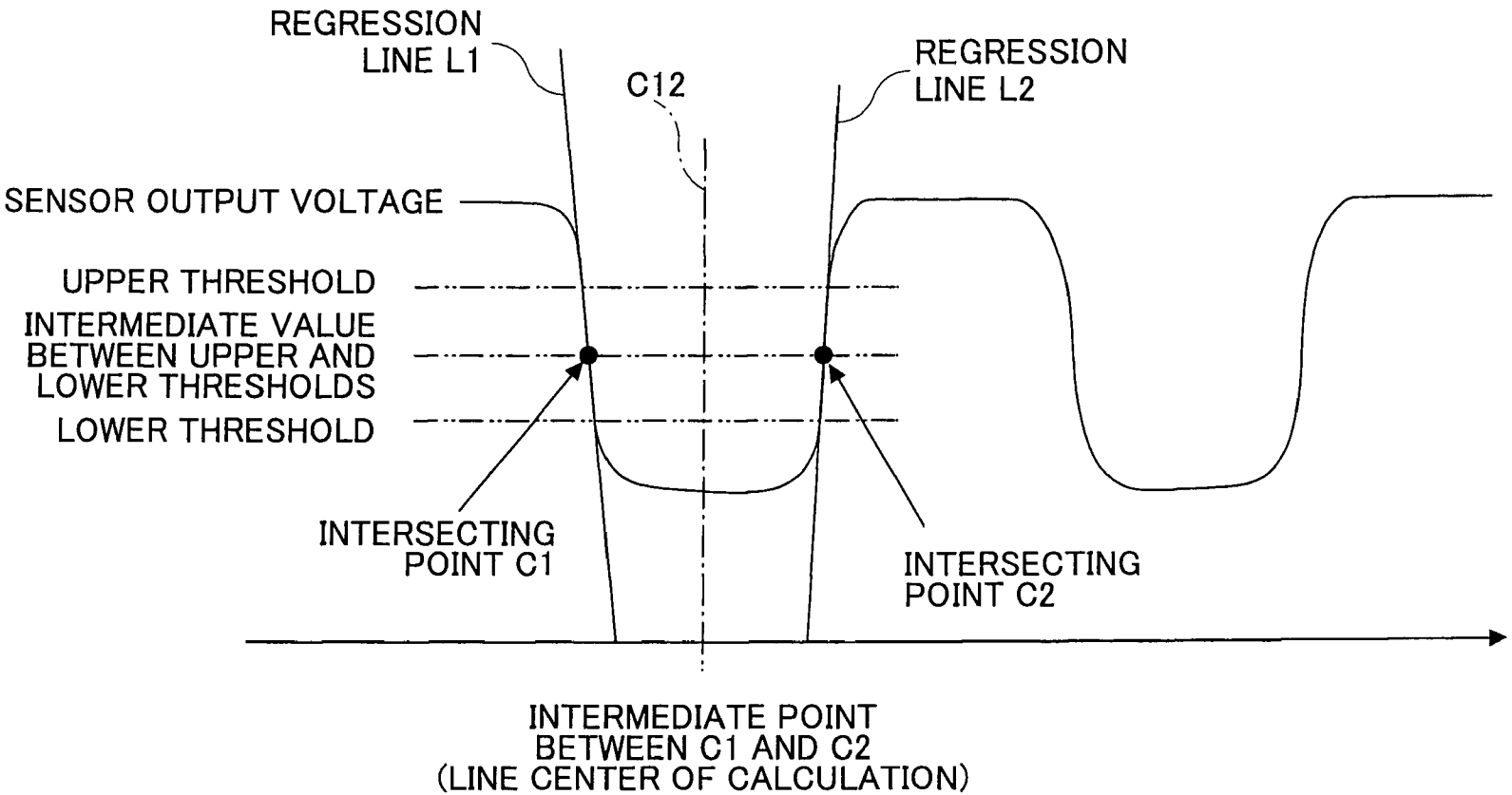
FIGS. 15A and 15B illustrate a second example of a process for detecting the position of an adjustment pattern.
Figure 15B:
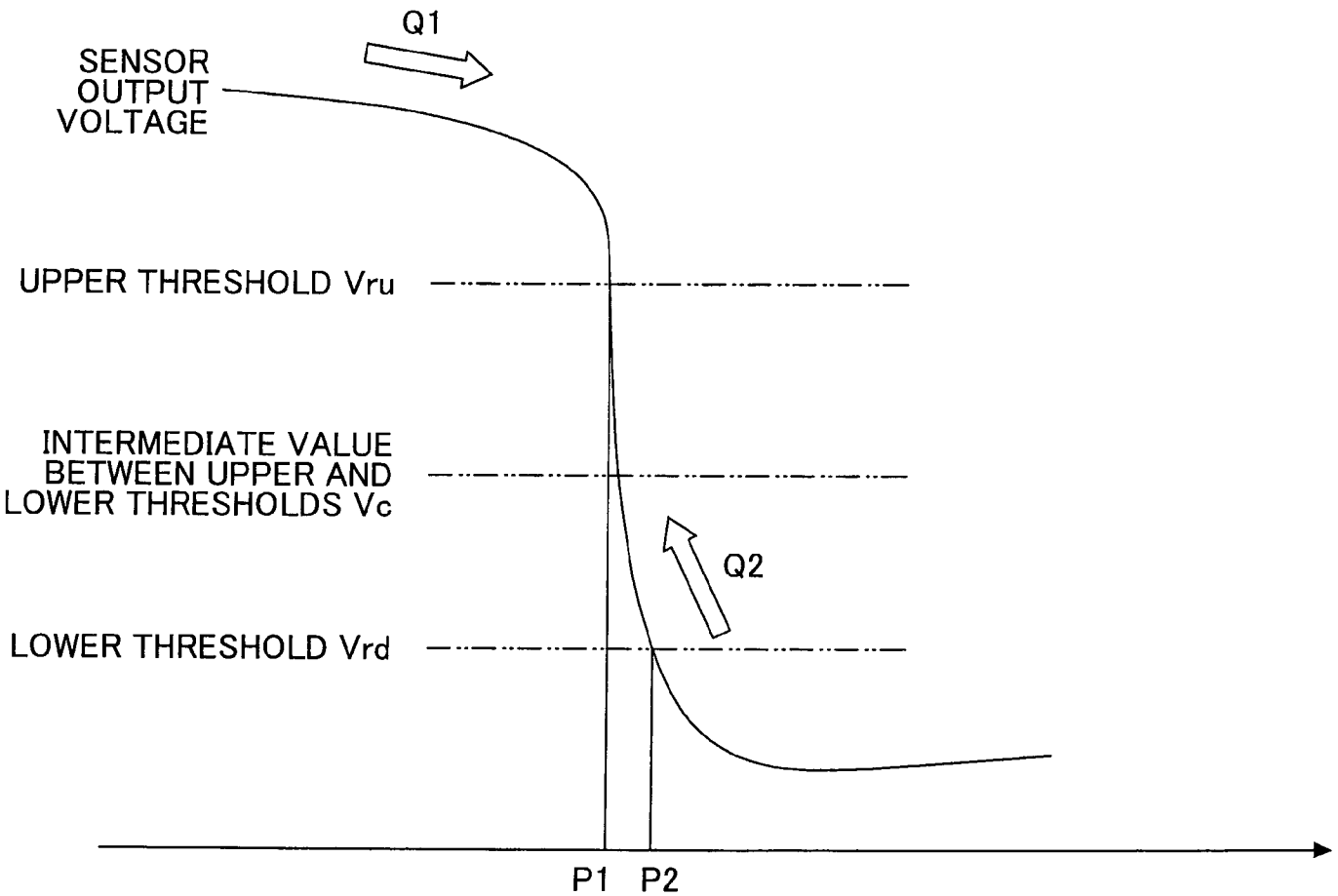

FIGS. 15A and 15B illustrate a second example. By scanning the same reference and measurement patterns 400*a* and 400*b* as those of the first example with the pattern reading sensor 401, a sensor output voltage So as shown in FIG. 15A can be obtained. FIG. 15B is an enlarged view of the portion where the sensor output voltage So falls.

This portion where the sensor output voltage So falls is searched in a direction indicated by an arrow Q1 shown in FIG. 15B, and the point where the sensor output voltage So falls below (becomes less than or equal to) a lower threshold Vrd is stored as a point P2. Next, from the point P2, the sensor output voltage So is searched in a direction indicated by an arrow Q2, and the point where the sensor output voltage So exceeds an upper threshold Vru is stored as a point P1. Then, a regression line L1 is calculated from the output voltage So between the point P1 and the point P2. An obtained regression line formula is used to calculate an intersection point C1 of the regression line L1 and an intermediate value Vrc of the upper and lower thresholds. In the same manner, a regression line L2 is calculated for the rising portion of the sensor output voltage So. An intersection point C2 of the regression line L2 and the intermediate value Vrc of the upper and lower thresholds is calculated. Based on the intermediate point of the intersection point C1 and the intersection point C2, a line center C12 is obtained by (intersection point C1+ intersection point C2)/2.

Figures 16A, 16B:
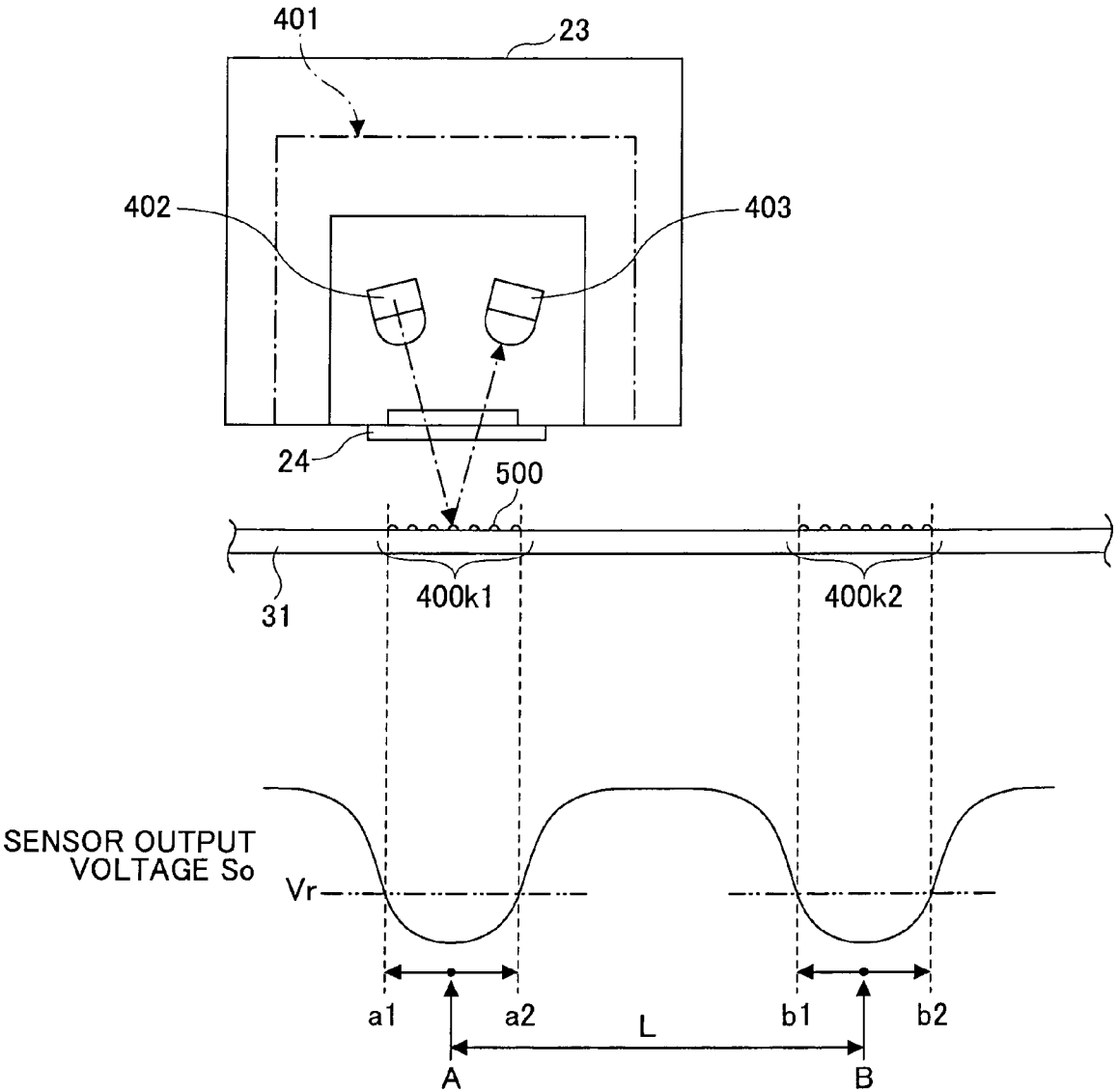
FIGS. 16A and 16B illustrate a third example of a process for detecting the position of an adjustment pattern.
Figure 17A:
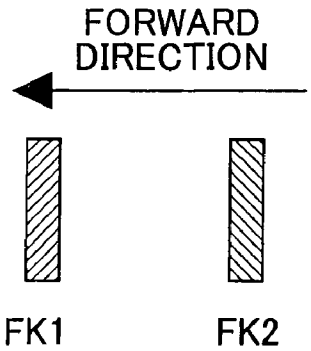
FIGS. 17A through 17D illustrate block patterns (basic patterns)
Figure 17B:
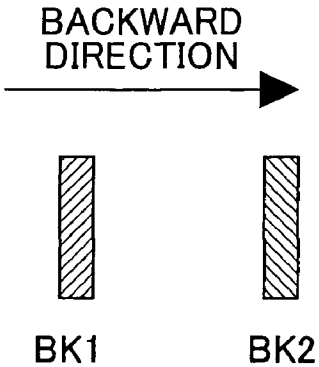
Figure 17C:
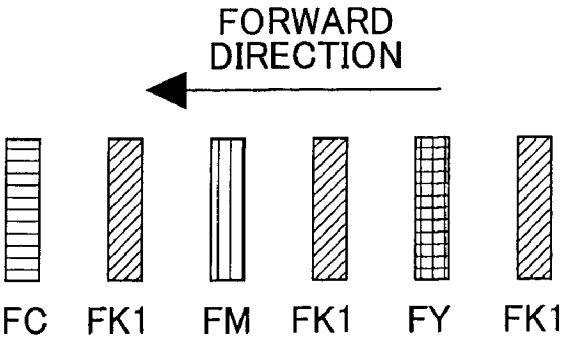
Figure 17D:
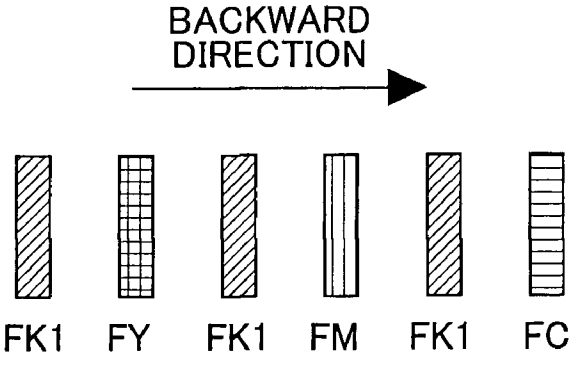

FIGS. 16A and 16B illustrate a third example. As shown in FIG. 16A, similar to the first example, the reference pattern 400*a* and the measurement pattern 400*b* is formed on the conveying belt 31. These are scanned with the pattern reading sensor 401 in the main scanning direction. Accordingly, a sensor output voltage So (photoelectric conversion output voltage) is obtained, as shown in FIG. 16B.

A process is performed to remove harmonic noise with an IIR filter, and then the quality of the detected signals is evaluated (whether there are missing signals, unstable signals, or excessive signals). Sloped portions near the threshold Vr are detected, and a regression curve is calculated. Furthermore, intersection points a1, a2, b1, and b2 of the regression curve and the threshold Vr are calculated (in a practical situation, the calculation is performed by a position counter). Moreover, an intermediate point A of the intersection points a1 and a2, and an intermediate point B of the intersection points b1 and b2 are calculated.

With reference to FIGS. 17A through 17D, a description is given of a block pattern (also referred to as basic pattern) for each minimum unit for detecting landing positional misalignment included in the adjustment pattern according to an embodiment of the present invention.

In the landing positional misalignment correction method for this image forming apparatus, a line-shaped pattern is formed on the conveying belt using a recording head (color) that is to be a reference head in such a manner so as to extend in a direction perpendicular to the movement direction of the conveying belt. By other recording heads (of other colors), similar line-shaped patterns are formed with fixed intervals along the movement direction of the conveying belt. The distance between the reference head and another head is calculated (measured).

There are four types of block patterns (basic patterns) for each minimum unit, as follows. In the basic pattern shown in FIG. 17A, when the image formation is performed in the forward direction (first scan), a reference pattern FK1 formed by the recording head 24*k*1 is used as a reference for detecting the landing positional misalignment of a measurement pattern FK2 formed by the recording head 24*k*2. In the basic pattern shown in FIG. 17B, when the image formation is performed in the backward direction (second scan), a reference pattern BK1 formed by the recording head 24*k*1 is used as a reference for detecting the landing positional misalignment of a measurement pattern BK2 formed by the recording head 24*k*2. In the basic pattern shown in FIG. 17C, when the image formation is performed in the forward direction (third scan), reference patterns FK1 formed by the recording head 24*k*1 are used as references for detecting the landing positional misalignment of measurement patterns FC, FM, and FY of colors C, M, and Y formed by the recording heads 24*c*, 24*m*, and 24*y*, respectively. In the basic pattern shown in FIG. 17D, when the image formation is performed in the backward direction (fourth scan), reference patterns FK1 formed by the recording head 24*k*1 is used as references for detecting the landing positional misalignment of measurement patterns FC, FM, and FY of colors C, M, and Y formed by the recording heads 24*c*, 24*m*, and 24*y*, respectively. These block patterns can be combined to form an adjustment pattern for obtaining various detection results.

Landing positional misalignment could be caused by a single recording head during bidirectional printing. However, in the case of the above-described image forming apparatus, since it includes two recording heads 24*k*1 and 24*k*2 for jetting black ink, landing positional misalignment may also be attributable to a discrepancy between the two recording heads 24*k*1 and 24*k*2. Therefore, the image forming apparatus includes the block pattern for detecting the landing positional misalignment of the pattern FK2 formed by the recording head 24*k*2 using the pattern FK1 formed by the recording head 24*k*1.

Figure 18:
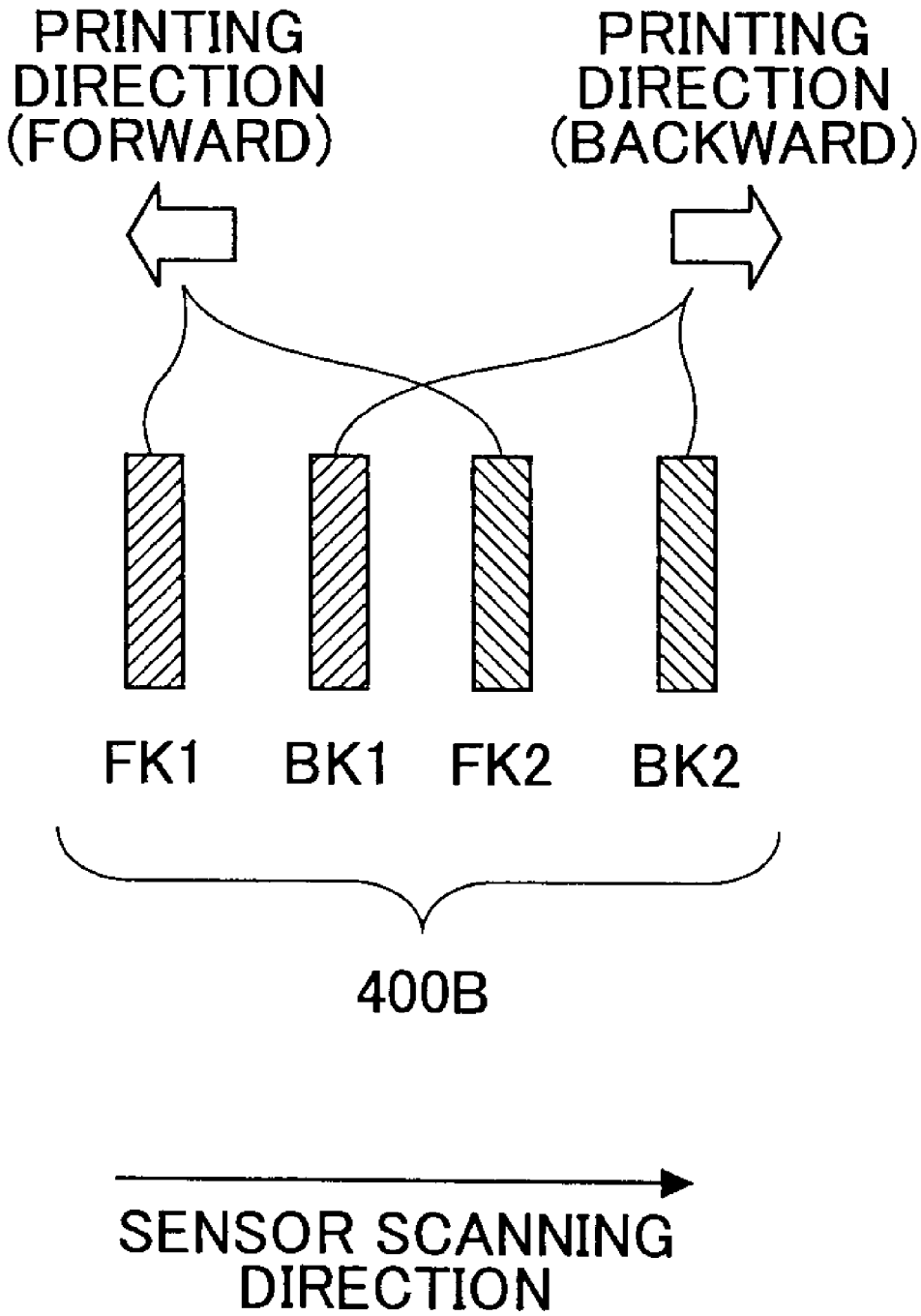
FIG. 18 illustrates a ruled line misalignment adjustment pattern.
Figure 19A:
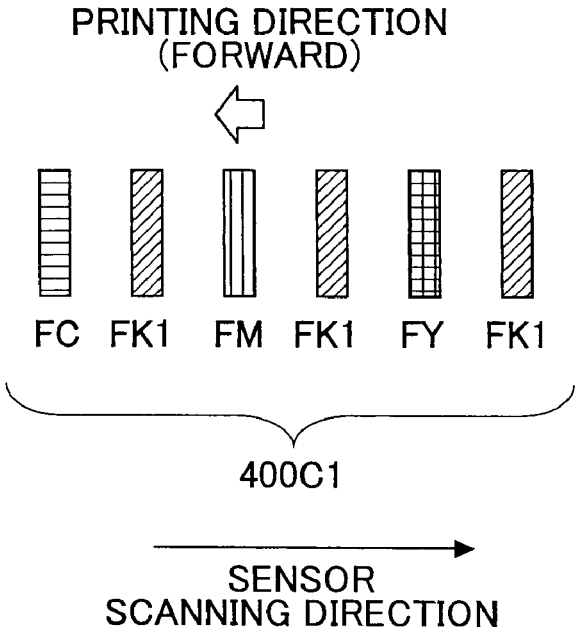
FIGS. 19A and 19B illustrate color registration error adjustment patterns.
Figure 19B:
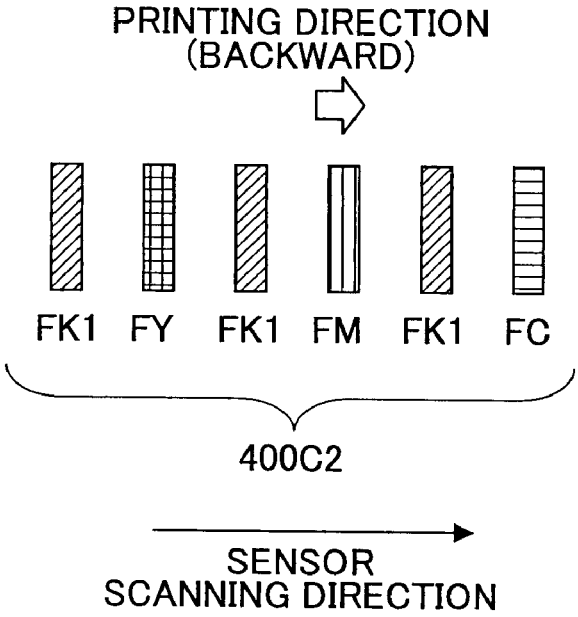

Next, with reference to FIGS. 18, 19A, and 19B, adjustment patterns including the above block patterns are described. One adjustment pattern is for detecting misalignment in monochrome ruled lines and another is for detecting color registration errors.

In a ruled line misalignment adjustment pattern 400B shown in FIG. 18, the position of the pattern FK1 in the reference direction (assumed to be forward direction) is used as a reference (the pattern FK1 is used as a reference pattern) for printing, at predetermined intervals, the pattern BK1 in the backward direction, the pattern FK2 in the forward direction, and the pattern BK2 in the backward direction (these are measurement patterns). Thus, based on the position information of each of the patterns FK1, BK1, FK2, and BK2, it is possible to detect the landing positional misalignment with respect to the pattern FK1 which is the reference pattern. The sensor scanning direction (reading direction) in FIG. 18 indicates a case where only one direction is read.

FIGS. 19A and 19B illustrate color registration error adjustment patterns 400C1 and 400C2, respectively. In these patterns, the reference color is used as a reference (the patterns FK1 recorded by the recording head 24*k*1 are used as reference patterns) for printing patterns FY, FM, and FC of the respective colors at predetermined intervals (these are measurement patterns). The landing positions of patterns FK1 and FY, FK1 and FM, and FK1 and FC are detected in order to detect the landing positions of each color pattern with respect to the corresponding reference pattern FK1. The sensor scanning direction (reading direction) in FIGS. 19A and 19B indicates a case where only one direction is read.

Figure 20:
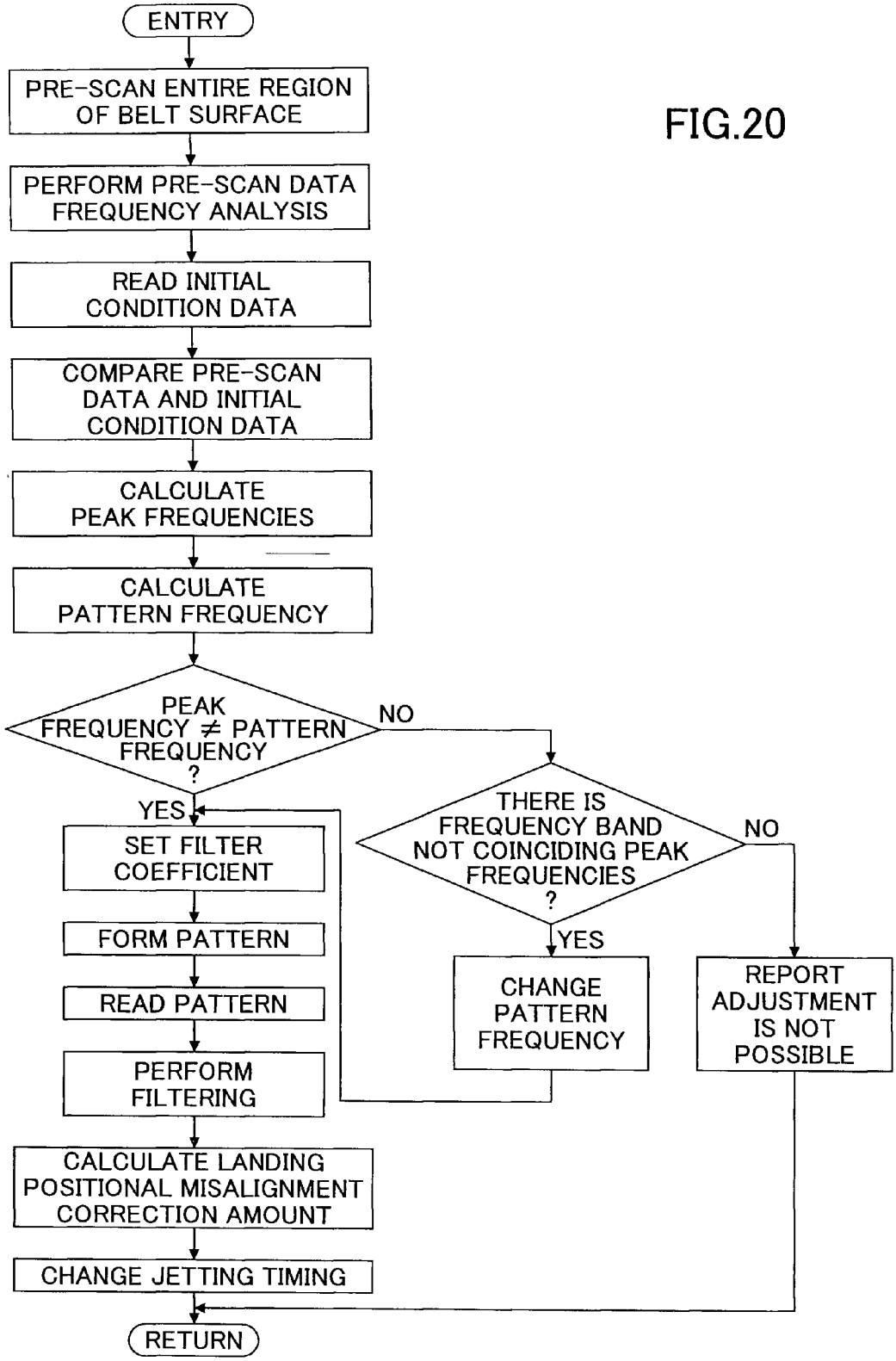
FIG. 20 is a flow chart of a first example of a landing positional misalignment correction process.

With reference to a flowchart shown in FIG. 20 and diagrams of FIGS. 21 through 27, the following describes a first example of a landing positional misalignment adjustment (correction) process performed by the main control unit 310. When this process is directed to be performed, prior to the formation of the adjustment pattern 400, the main control unit 310 moves the carriage 23 in the main scanning direction to pre-scan the entire region of the conveying belt 31 with the pattern reading sensor 401, thereby reading the condition of the surface of the conveying belt 31 (belt surface).

Figure 21:
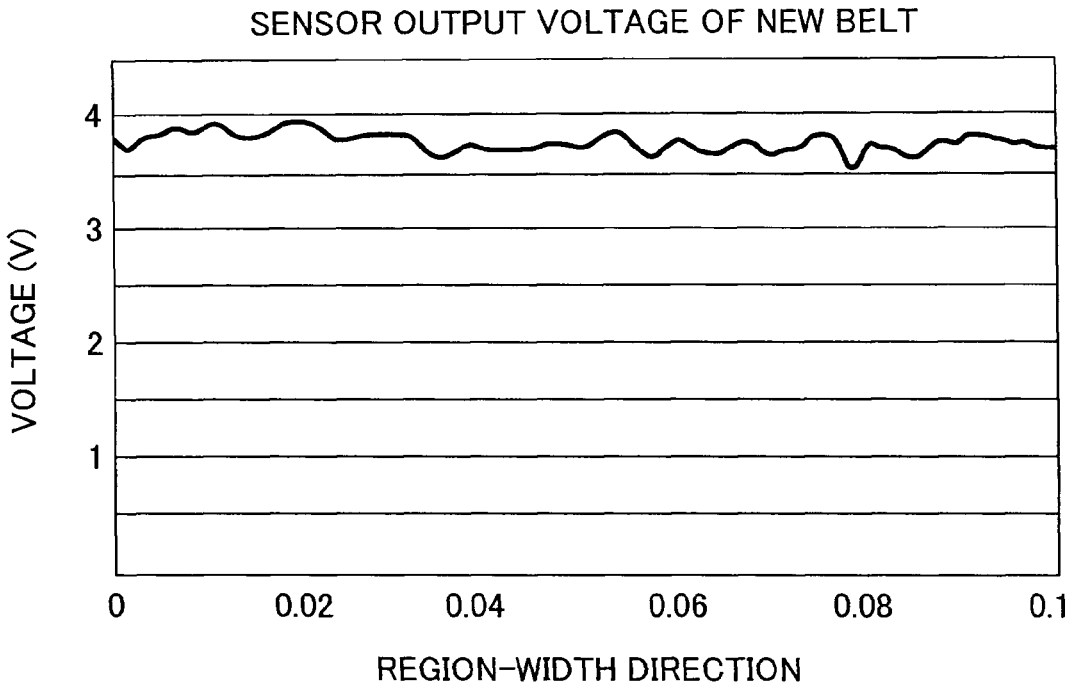
FIG. 21 illustrates an example of a sensor output voltage of a new belt.

If the conveying belt 31 remains clean, the sensor output voltage of the pattern reading sensor 401 is stable and takes on a profile similar to one shown in FIG. 21, which is the sensor output voltage obtained from a new belt. On the other hand, when there are scratches and dirt on the surface of the conveying belt 31, the sensor output voltage is unstable and largely fluctuates like one shown in FIG. 23, which is the sensor output voltage obtained from an aging belt. Note that the "new belt" means an unused conveying belt, for example, in factory shipment, and the "aging belt" means a belt having been actually used.

Next, the main control unit 310 performs a frequency analysis in which frequencies of the belt surface and amplitudes of respective frequency components are calculated based on the sensor output voltage of the pattern reading sensor 401 obtained in the pre-scanning. In the frequency analysis, the obtained sensor output voltage (pre-scan data) along the time axis of the belt surface is converted into a signal along the frequency axis.

Figure 22:
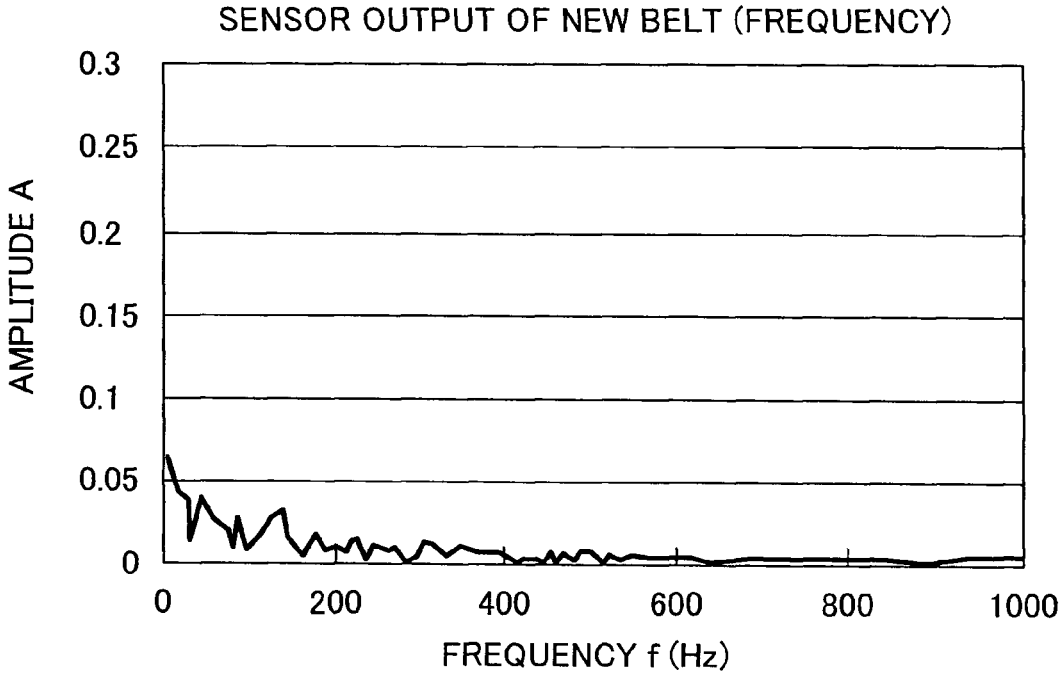
FIG. 22 illustrates an FFT analysis result of FIG. 21.
Figure 23:
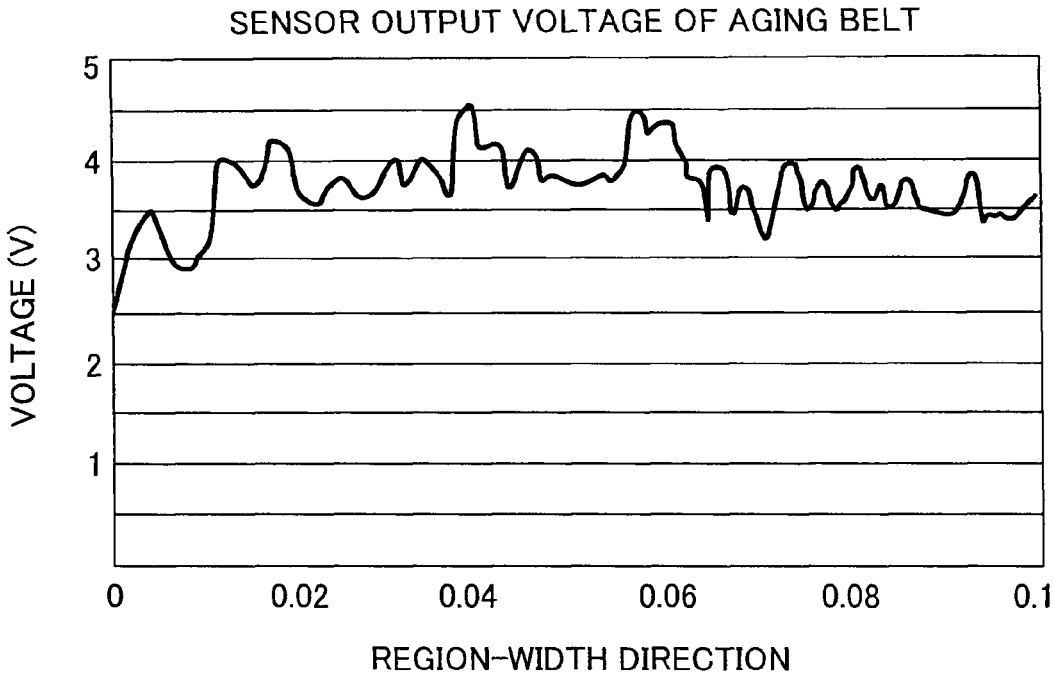
FIG. 23 illustrates an example of a sensor output voltage of an aging belt.

If the frequency analyzing unit 507 converts (fast Fourier transform), for example, the sensor output voltage shown in FIG. 21 into a signal along the frequency axis, the outcome would be one shown in FIG. 22. If the frequency analyzing unit 507 converts the sensor output voltage obtained from the aging belt of FIG. 23 into a signal along the frequency axis, the outcome would be one shown in FIG. 24. Compared to FIG. 22, it can be seen that there are multiple peaks at certain frequency components of the signal (frequencies fb1, fb2 and the like in FIG. 24). These peaks are attributed to the superposition of frequency components of scratches and dirt on the belt. Note that in FIG. 24, only frequency components that become a problem are indicated (i.e. fb1, fb2 and the like).

Next, the main control unit 310 reads pre-stored belt surface frequency data (initial condition data, for example, frequency data obtained from the surface of the conveying belt in factory shipment), and performs a peak frequency calculating process in which, using the frequencies of the belt surface and the amplitudes of respective frequency components obtained by the frequency analysis, frequency components exceeding a predetermined level are calculated as peak frequencies. That is, the belt surface frequency data obtained in the pre-scanning are compared with the initial condition data to calculate their difference, and frequency components whose difference in amplitude exceeds a predetermined value (predetermined level) are searched. These frequency components are stored in a nonvolatile memory (storing unit) as peak frequencies.

Figure 24:
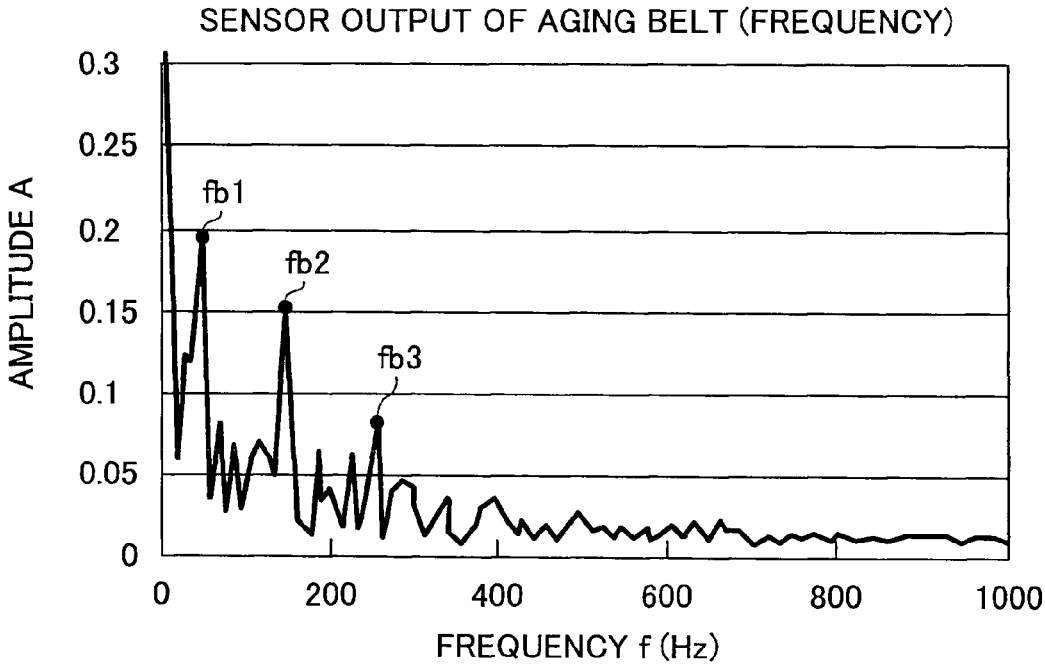
FIG. 24 illustrates an FFT analysis result of FIG. 23.
Figure 25:
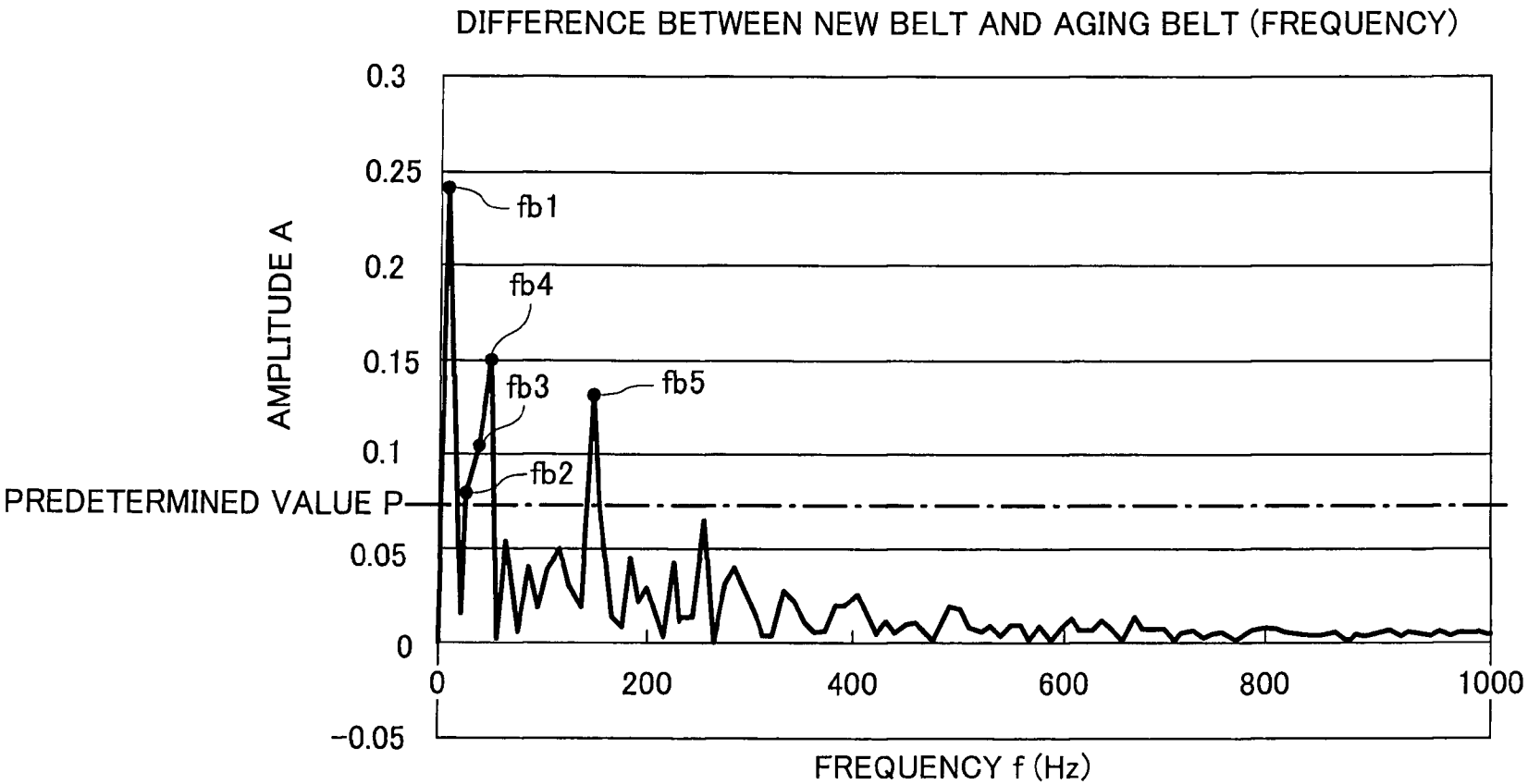
FIG. 25 illustrates a difference (frequency) between the new belt and the aging belt.

For example, assume that the initial condition data are the belt surface frequency data of the new belt of FIG. 22, and that the belt surface frequency data of the aging belt of FIG. 24 are obtained by pre-scanning. Difference in amplitude of the belt surface frequency data of pre-scanning and the initial condition data is calculated, as illustrated in FIG. 25. Then, frequency components whose difference in amplitude exceeds a predetermined value are searched (fb1, fb2 and the like in FIG. 25), and these frequencies (peak frequencies) are stored in a recording medium.

Next, the main control unit 310 compares an initial value of the frequency for the adjustment pattern 400 (pattern frequency) with the calculated peak frequencies to determine whether the peak frequencies are different from the pattern frequency. It should be noted that the pattern frequency is a frequency band within a predetermined range which includes the calculated peak frequencies, or includes the calculated peak frequencies as well as frequencies adjacent to the peak frequencies.

For example, the initial value of the pattern frequency of the adjustment pattern 400 is compared with the peak frequencies fb1, fb2 and the like in FIG. 25 so as to determine whether a peak frequency is within an initial value range of the pattern frequency.

At this point, if the pattern frequency is determined to be different from any of the peak frequencies, the main control unit 310 sets, for a filter, a filter coefficient such that the filter has a cut-off frequency f0 beyond the pattern frequency and frequencies adjacent to the pattern frequency.

If the pattern frequency is similar to one of the peak frequencies, the main control unit 310 changes the pattern frequency. Specifically, the main control unit 310 searches a frequency band that does not coincide with any of the peak frequencies, in ascending order starting from a frequency band of the lowest peak frequency. If there is a frequency band that does not coincide with any of the peak frequencies, the main control unit 310 changes the pattern frequency of the adjustment pattern 400 to the found frequency band. Subsequently, the main control unit 310 sets, for the filter, a filter coefficient such that the filter has a cut-off frequency beyond the changed pattern frequency and frequencies adjacent to the changed pattern frequency.

Next, the main control unit 310 forms the adjustment pattern 400 on the conveying belt 31 and reads the adjustment pattern 400 with the pattern reading sensor 401, and then performs filtering on the read data with the filter.

Figure 26A:
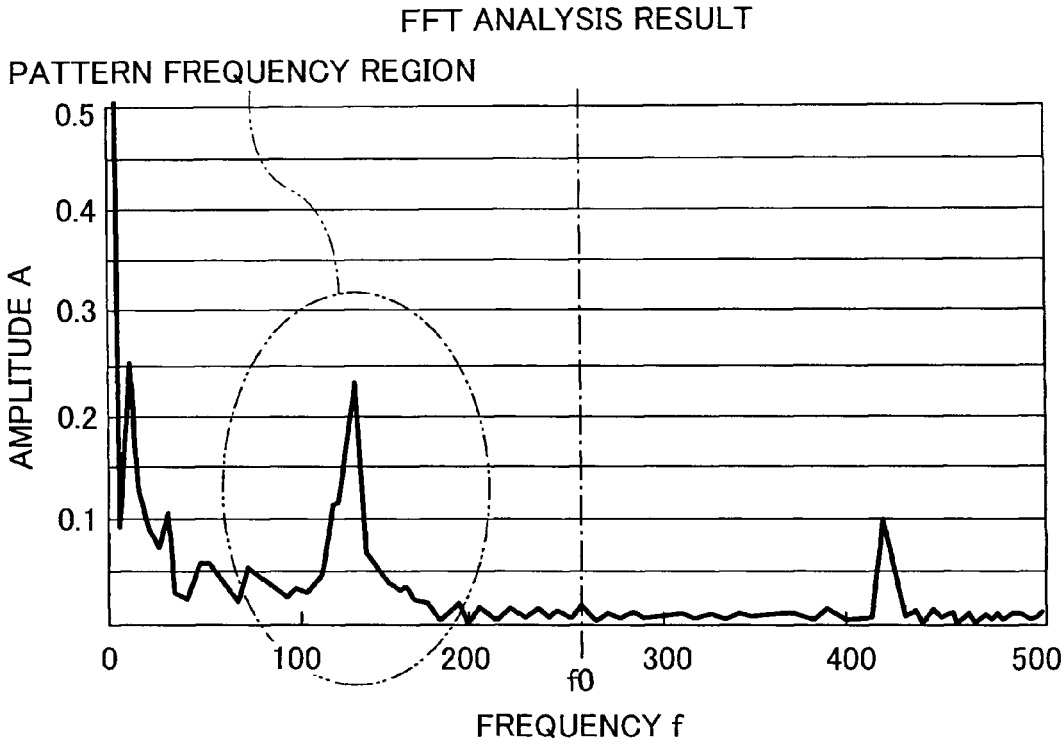
FIGS. 26A and 26B illustrate a cut-off frequency of a pattern frequency and a filtering process result.
Figure 26B:
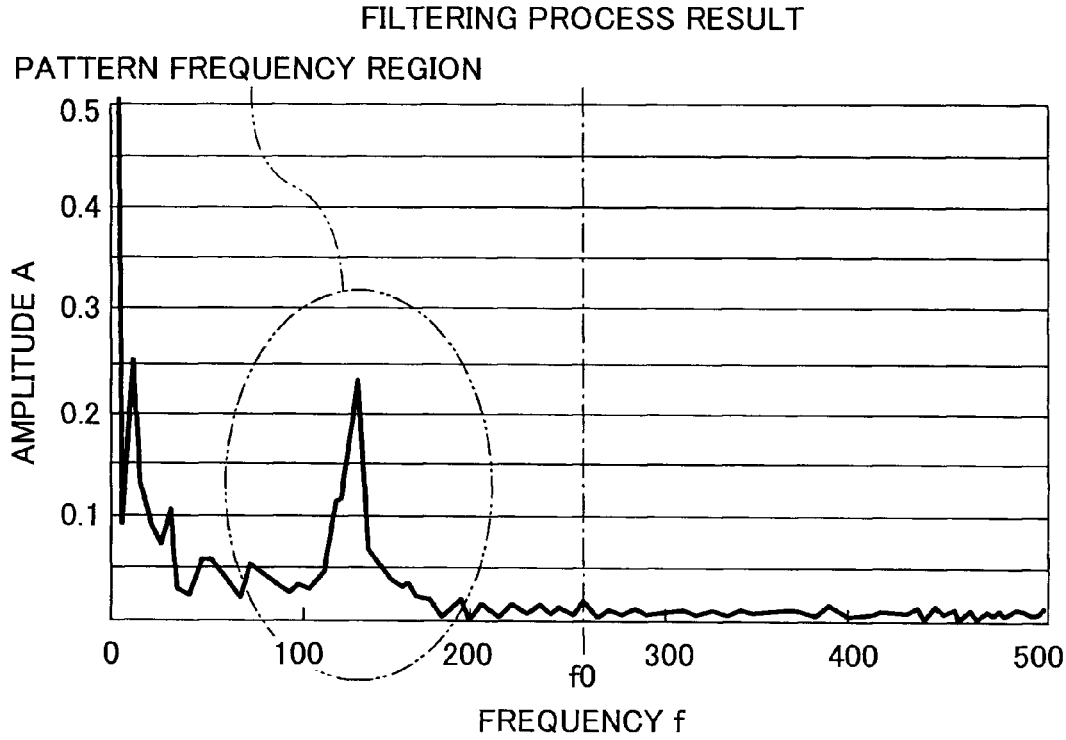

For example, as shown in FIG. 26A, a frequency component beyond a pattern frequency region (the pattern frequency and its adjacent frequencies) is set for the filter as the cut-off frequency f0. Accordingly, when the filtering process is performed, frequency components at and beyond the cut-off frequency f0 are cut off, as shown in FIG. 26B.

Figure 27:
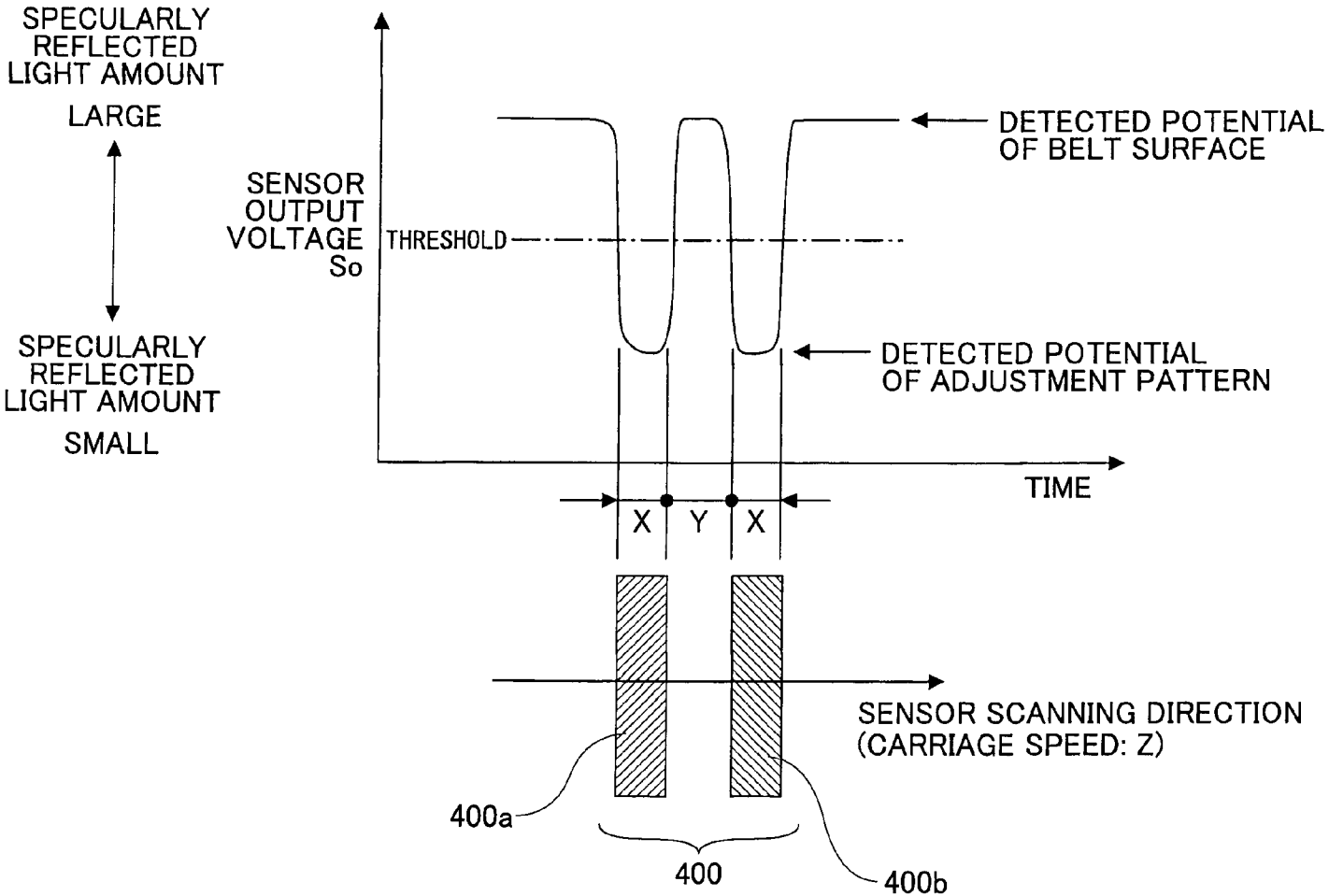
FIG. 27 illustrates the pattern frequency.

The pattern frequency is obtained by $1/\{(X+Y)/Z\}$, where X is the pattern width of the reference pattern 400*a* and the measurement pattern 400*b*, Y is the gap between these two patterns, and Z is the carriage speed (reading speed), as shown in FIG. 27. For example, if X is 1 mm, Y is 1 mm and Z is 300/s, the pattern frequency is $1/\{(1+1)/300\}=150$ Hz.

Therefore, in order to change the pattern frequency of the adjustment pattern 400, either one of the pattern width X of the reference pattern 400*a* and the measurement pattern 400*b* or the pattern gap Y may be changed. A new frequency band of the pattern frequency is determined depending on the peak frequencies.

Next, the main control unit 310 detects the position of the adjustment pattern 400 based on the sensor output from the pattern reading sensor 401, and detects the landing positional misalignment amount. In this case, the landing positional misalignment amount is calculated by obtaining a discrepancy with a specified distance. The discrepancy may be obtained by identifying the position of the adjustment pattern 400 using addresses (position information) obtained by the linear encoder for detecting movements of the carriage 23, or, alternatively, by calculating the pattern-to-pattern distance based on the pattern-to-pattern time and the carriage speed. Subsequently, the main control unit 310 calculates the landing positional misalignment correction amount and adjusts the landing positional misalignment by changing the jetting timing.

Next, the main control unit 310 calculates a correction value of the printing jetting timing based on a discrepancy between the forward printing and the backward printing (bidirectional misalignment amount) of the carriage 23. Using the calculated correction value, the main control unit 310 corrects the printing jetting timing.

On the other hand, if the pattern frequency coincides with one of the peak frequencies over almost all frequency bands, and thus, there is no frequency band to which the pattern frequency can be changed, the main control unit 310 reports to the user and the service provider that the positional misalignment cannot be adjusted. By reporting the unadjustable condition, it is possible to reduce downtime when positional misalignment cannot be adjusted.

As has been described above, the belt surface is pre-scanned to obtain its condition, and the frequency analysis (FFT) is performed on the output of the belt surface. Then, peak frequencies are detected, and an adjustment pattern is formed at a frequency different from the frequencies of the belt surface. Herewith, the adjustment pattern is free from the influence of frequency components (scratches caused by paper powder, dirt due to ink mist and the like) on the belt surface which are not present in the initial condition. Accordingly, even if the condition of the belt surface changes, the position of the adjustment pattern can be detected with less possibility of misdetection and accordingly, the landing positional misalignment can be appropriately adjusted.

Figure 28:
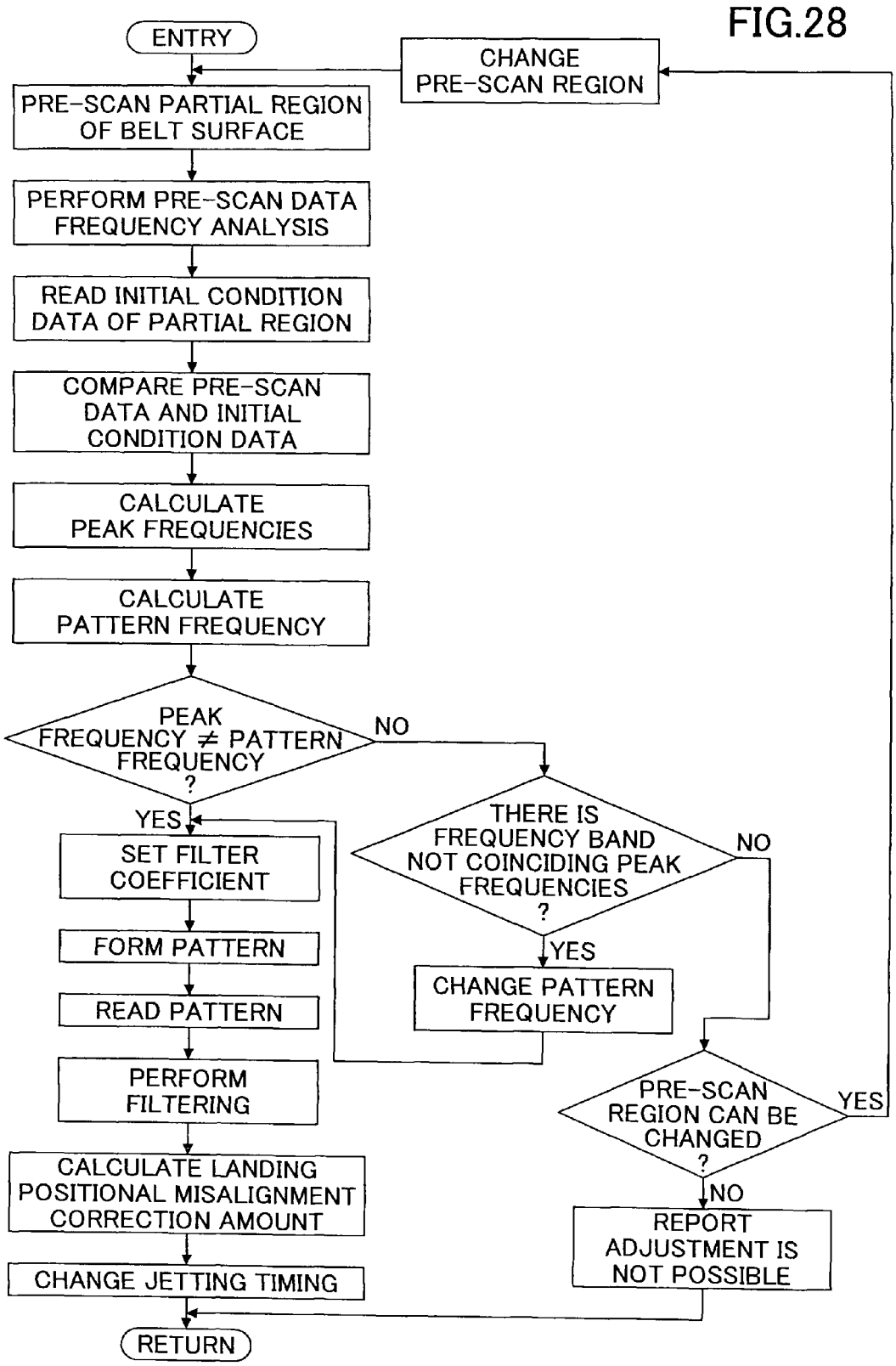
FIG. 28 is a flow chart of a second example of the landing positional misalignment correction process.
Figure 29:
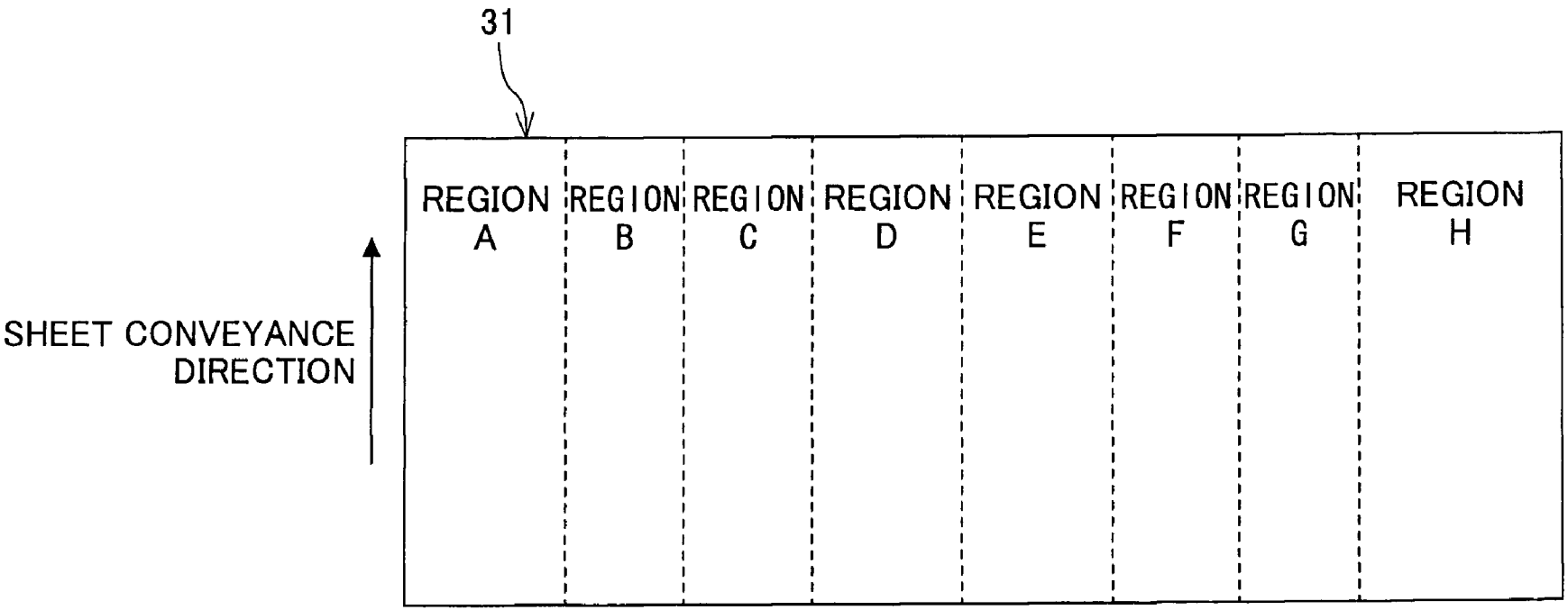
FIG. 29 illustrates pattern formation regions.

Next, with reference to a flowchart shown in FIG. 28 and a diagram of FIG. 29, a second example of a landing positional misalignment adjustment (correction) process performed by the main control unit 310 is explained.

In this example, prior to the formation of the adjustment pattern 400, the carriage is moved in the main scanning direction to pre-scan only a predetermined pattern printing region with the reading sensor 401, thereby reading the condition of the surface of the conveying belt 31 (belt surface). FIG. 29 shows an example of multiple divisional regions (regions A through H) on the surface of the conveying belt 31. One or more of the regions A through H are pre-scanned, and these pre-scanned pattern formation regions are then recorded in a storage medium.

Subsequently, as explained in the first example above, the frequency analysis is performed on the pre-scanned pattern formation regions to calculate frequencies of the pattern formation regions and amplitudes of respective frequency components based on the sensor output voltage of the pattern reading sensor 401 obtained in the pre-scanning. In the frequency analysis, the obtained sensor output voltage (pre-scan data) along the time axis of the belt surface is converted into a signal along the frequency axis.

Next, a difference between the initial condition data (belt surface frequency data) for the pre-scanned regions and the belt surface frequency data obtained in the pre-scanning is calculated, and frequency components whose difference in amplitude exceeds a predetermined value are searched. These frequency components are stored in a nonvolatile memory (storing unit) as peak frequencies.

Next, an initial value of the pattern frequency is compared with the calculated peak frequencies. If none of the peak frequencies is within the initial value range of the pattern frequency, a filter coefficient such that the filter has a cut-off frequency f0 beyond the pattern frequency and frequencies adjacent to the pattern frequency is set for the filter. Subsequently, the adjustment pattern 400 is formed, and the positional misalignment adjustment is carried out.

If the pattern frequency is similar to one of the peak frequencies, the pattern frequency is changed. Specifically, a frequency band that does not coincide with any of the peak frequencies is searched in ascending order starting from a frequency band of the lowest peak frequency. If there is a frequency band that does not coincide with any of the peak frequencies, the pattern frequency is changed to the found frequency band. Subsequently, a filter coefficient such that the filter has a cut-off frequency f0 beyond the changed pattern frequency and frequencies adjacent to the changed pattern frequency is set for the filter. Then, the adjustment pattern 400 is formed, and the positional misalignment adjustment is carried out.

On the other hand, if, in the pre-scanned pattern formation regions, the pattern frequency coincides with one of the peak frequencies over almost all frequency bands, one or more regions different from the pre-scanned regions are pre-scanned. Then, a frequency band which does not coincide with the peak frequencies is searched, and subsequently, the same processes as described above in the first example are performed. If, in all the pattern formation regions (in this example, all regions A through H), the pattern frequency coincides with one of the peak frequencies over almost all frequency bands, the unadjustable condition is reported to the user and the service provider. By reporting the unadjustable condition, it is possible to reduce downtime when positional misalignment cannot be adjusted.

Thus, by pre-scanning only the pattern formation region (a region on which a pattern is to be formed), it is possible to improve the processing speed and also reduce a storage area of the storage medium used during the processing operations. Furthermore, the pattern detection sensitivity can be continuously maintained.

In conclusion, according to the image forming apparatus of the present invention, the adjustment pattern is formed at a frequency different from the frequencies of the surface of the conveying belt. Therefore, it is possible to maintain at a stable level pattern detection accuracy and accuracy of correcting the misalignment of the liquid droplet landing positions.

This application is based on Japanese Patent Application No. 2008-008849 filed on Jan. 18, 2008, the contents of which are hereby incorporated herein by reference.

What is claimed is:

1. An image forming apparatus comprising:

a carriage having a recording head for jetting liquid droplets;

a pattern forming unit configured to form, on a conveying belt, an adjustment pattern used for detecting displacement of landing positions of the liquid droplets;

a reading unit mounted on the carriage, including a light emitting unit and a light receiving unit, and configured to scan and read the conveying belt before the adjustment pattern is formed thereon so as to output a first reading result, and scan and read the adjustment pattern on the conveying belt so as to output a second reading result;

a correcting unit configured to correct the displacement of the landing positions based on the second reading result;

a frequency analyzing unit configured to calculate frequencies of a surface of the conveying belt and amplitudes of respective frequency components thereof based on the first reading result; and a peak frequency calculating unit configured to calculate one or more peak frequencies of the surface of the conveying belt based on the frequencies of the surface of the conveying belt and the amplitudes of the frequency components, the peak frequencies being one or more of the frequency components whose amplitude exceeds a predetermined level;

wherein the pattern forming unit forms the adjustment pattern at a frequency different from the peak frequencies.

2. The image forming apparatus as claimed in claim 1, wherein the adjustment pattern includes at least two pattern units, and the pattern forming unit sets the frequency of the adjustment pattern by specifying at least one of a width of each minimum pattern unit and a distance between the minimum pattern units.

3. The image forming apparatus as claimed in claim 1, further comprising a filtering unit configured to perform filtering on the second reading result by cutting off frequency components higher than a frequency region which encompasses the frequency of the adjacent pattern and frequencies adjacent to the frequency of the adjustment pattern.

4. The image forming apparatus as claimed in claim 3, further comprising a cut-off frequency calculating unit configured to determine the frequency components to be cut off by the filtering unit.

5. The image forming apparatus as claimed in claim 1, wherein the reading unit scans and reads at least one part of the conveying belt before the adjustment pattern is formed thereon so as to output the first reading result, the part of the conveying belt encompassing a region in which the adjustment pattern is to be formed, and it is determined, based on the first reading result, whether the adjustment pattern can be formed on the at least one part of the conveying belt.

6. The image forming apparatus as claimed in claim 5, further comprising a storing unit configured to store in memory data indicating of the at least one part of the conveying belt if it is determined that the adjustment pattern can be formed thereon.

7. The image forming apparatus as claimed in claim 6, wherein after the storing unit stores in memory the at least one part of the conveying belt, the pattern forming unit forms the adjustment pattern on the at least one part of the conveying belt.

8. The image forming apparatus as claimed in claim 1, further comprising a reporting unit configured to generate a report that the displacement of the landing positions cannot be corrected in a case where the peak frequencies are spread over a predetermined frequency band.

* * * * *